US007311394B2

(12) United States Patent
Ishikawa et al.

(10) Patent No.: US 7,311,394 B2
(45) Date of Patent: Dec. 25, 2007

(54) INK-JET PRINTING METHOD AND INK-JET PRINTING APPARATUS

(75) Inventors: Takuei Ishikawa, Tokyo (JP); Kazuhiro Nakajima, Yokohama (JP); Koichiro Nakazawa, Tokyo (JP); Katsuhiro Shirota, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/549,674

(22) PCT Filed: May 6, 2004

(86) PCT No.: PCT/JP2004/006419

§ 371 (c)(1),
(2), (4) Date: Sep. 19, 2005

(87) PCT Pub. No.: WO2004/098896

PCT Pub. Date: Nov. 18, 2004

(65) Prior Publication Data

US 2006/0176331 A1 Aug. 10, 2006

(30) Foreign Application Priority Data

May 7, 2003 (JP) ..... 2003-129227
Apr. 2, 2004 (JP) ..... 2004-110312

(51) Int. Cl.
*B41J 2/01* (2006.01)

(52) U.S. Cl. ..... 347/101; 347/98; 347/102

(58) Field of Classification Search ..... 347/98, 347/99, 100, 101, 102, 12, 42, 15, 16; 106/31.86
See application file for complete search history.

(56) References Cited

U.S. PATENT DOCUMENTS

| | | | | |
|---|---|---|---|---|
| 4,330,787 | A | 5/1982 | Sato et al. | 349/140 R |
| 4,459,600 | A | 7/1984 | Sato et al. | 346/140 R |
| 4,723,129 | A | 2/1988 | Endo et al. | 346/1.1 |
| 4,740,796 | A | 4/1988 | Endo et al. | 346/1.1 |
| 4,849,774 | A | 7/1989 | Endo et al. | 346/140 R |
| 5,122,814 | A | 6/1992 | Endo et al. | 346/33 R |
| 5,159,349 | A | 10/1992 | Endo et al. | 346/33 |
| 5,521,621 | A | 5/1996 | Endo et al. | 347/15 |
| 5,635,969 | A | 6/1997 | Allen | 347/96 |

(Continued)

FOREIGN PATENT DOCUMENTS

EP 0 517 543 12/1992

(Continued)

*Primary Examiner*—Lam Son Nguyen
(74) *Attorney, Agent, or Firm*—Fitzpatrick, Cella, Harper & Scinto

(57) ABSTRACT

A width A of the scanning area of the ink ejection orifices and a width B of the scanning area of the reacting liquid ejection orifices are respectively set as A=(n−a)×p and B=n×p, while amount of the feeding of the printing sheet during each scan corresponds to the width of the scanning area of the reacting liquid ejection orifices, that is, A=(n−a)×p. With this system, the width of the scanning area, wherein ejection of the reacting liquid precedes ejection of the ink, is made shorter by C=a×p than the width of following scanning area; the scanning area having the width C is scanned two times by the row of the ink ejection orifices, and the thinning process is applied to this area having the width C.

10 Claims, 9 Drawing Sheets

U.S. PATENT DOCUMENTS

| | | | | |
|---|---|---|---|---|
| 5,746,818 | A * | 5/1998 | Yatake | 106/31.36 |
| 5,754,194 | A | 5/1998 | Endo et al. | 347/15 |
| 6,126,282 | A | 10/2000 | Oikawa | 347/101 |
| 6,655,797 | B2 * | 12/2003 | Smith et al. | 347/98 |

FOREIGN PATENT DOCUMENTS

| | | |
|---|---|---|
| EP | 0 534 634 A1 | 3/1993 |
| EP | 0 739 743 | 10/1996 |
| EP | 1 029 688 | 8/2000 |
| JP | 61-59911 (B2) | 12/1986 |
| JP | 61-59912 (B2) | 12/1986 |
| JP | 61-59914 (B2) | 12/1986 |
| JP | 5-202328 (A) | 8/1993 |
| JP | 7-195823 (A) | 8/1995 |
| JP | 9-207424 (A) | 8/1997 |
| JP | 2001-138554 (A) | 5/2001 |

* cited by examiner

FIG.5A
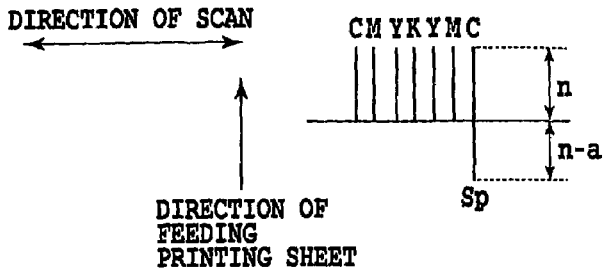
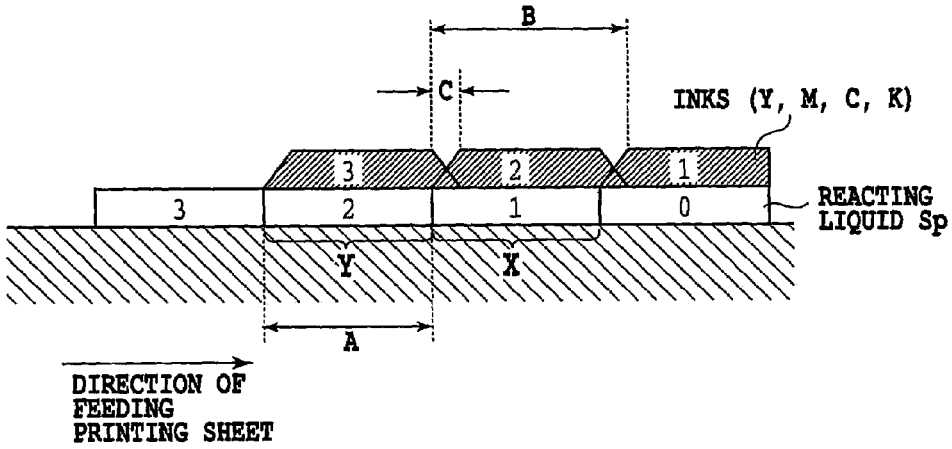
FIG.5B
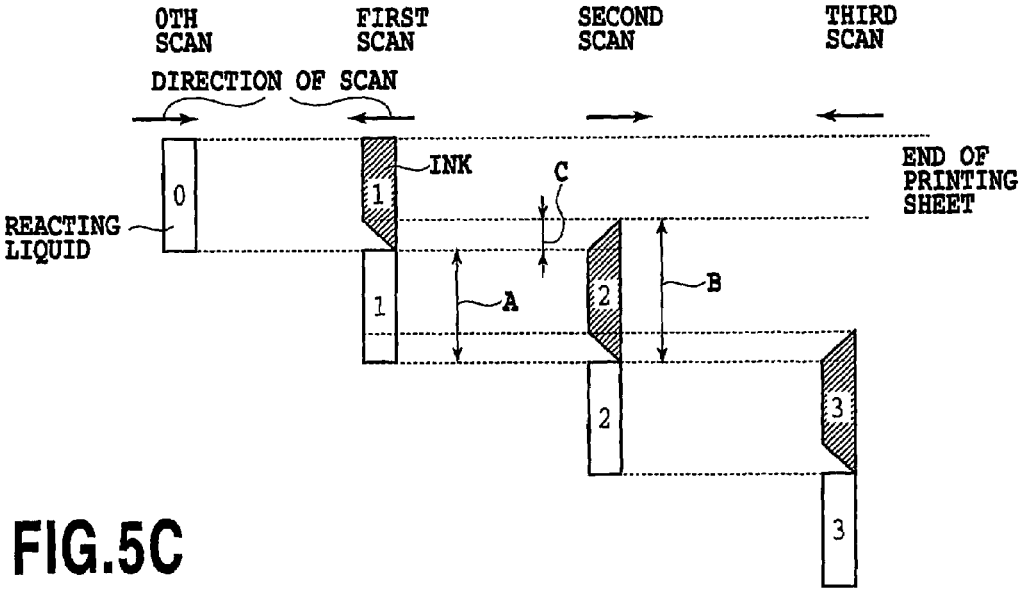
FIG.5C

FIG.8A
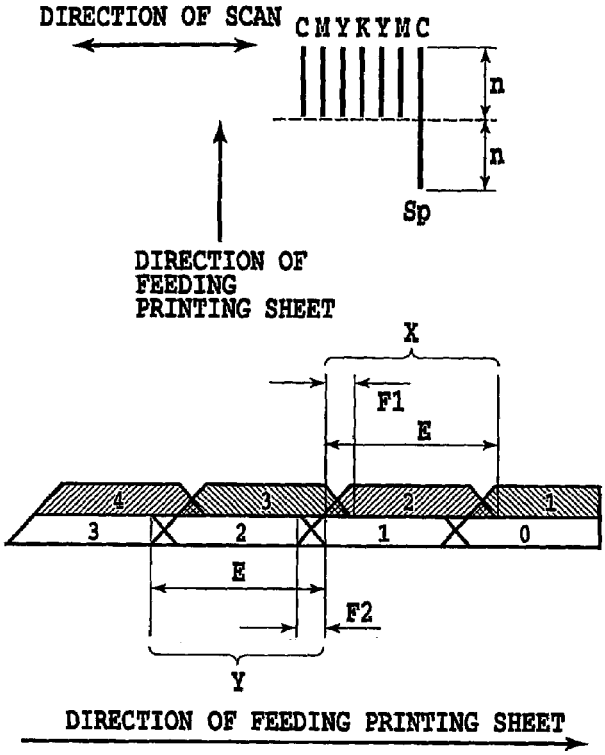
FIG.8B
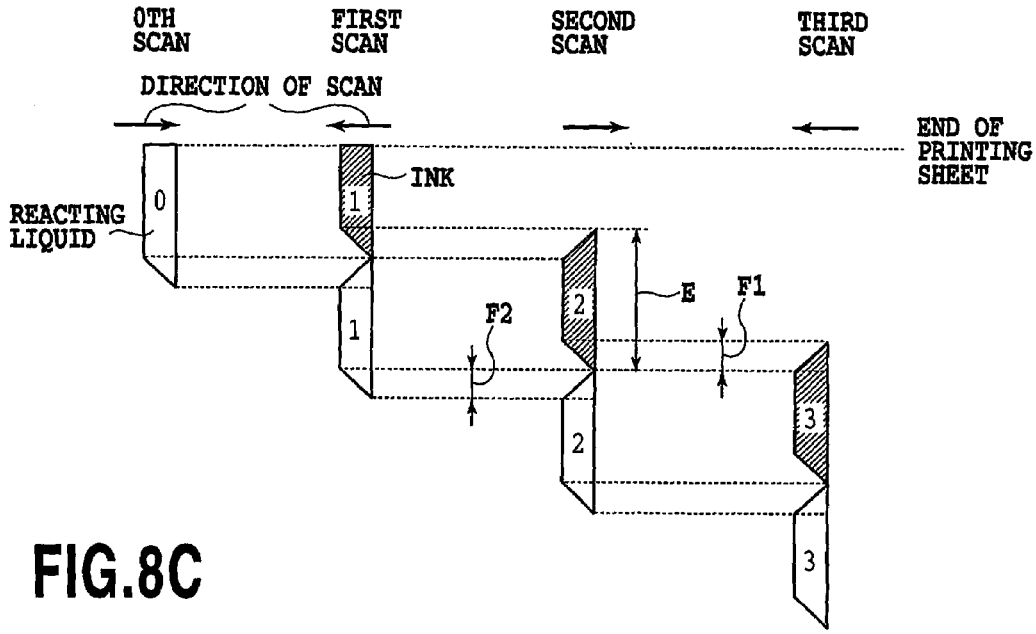
FIG.8C

INK-JET PRINTING METHOD AND INK-JET PRINTING APPARATUS

TECHNICAL FIELD

The present invention relates to an ink-jet printing method and an ink-jet printing apparatus, more specifically to the reduction of the non-uniformity of color, caused by the difference in the order of applying ink and a reacting liquid, during a bidirectional printing with use of a ink and a liquid for making a coloring substance contained in the ink insoluble (hereinafter referred to as reacting liquid).

BACKGROUND ART

Ink-jet printing methods are that eject ink in the form of fine drops for being deposited on the surface of a printing medium such as a printing paper so as to perform printing. Among such methods, especially, Japanese Patent Application Publication No. 61-059911 (1986), Japanese Patent Application Publication No. 61-059912 (1986)and Japanese Patent Application Publication No.61-059914 (1986) respectively propose a method designed so that the electro-thermal conversion element is used as an ejection energy generating element so that heat energy generated from the electro-thermal conversion element is applied to the ink to generate a bubble in the ink and to eject an ink droplet. These methods enable a high-density multiple-orifice printing head to be made available easily and thereby enable a high-resolution and a high-quality image to be printed quickly.

However, ink used in conventional ink-jet printing methods, including those described in the above-mentioned documents, contains water as a main component and a water soluble solvent having a high melting point such as the glycol for preventing the ink from drying and clogging. When such an ink is used for printing on a plain paper, an image having an adequate optical density may not be obtained owing to permeation of the ink into inside the paper and an unevenness of the optical density of the image may occur owing to probable uneven distribution of a loading filler and a sizing in the surface layer of the paper. Further, especially when printing a color image, a plurality of colors of inks are sequentially applied on the ink, which has been applied and not yet fixed, and then the applied inks may spread at a boundary portion between different colors of the image to mix together(hereinafter referred to as bleeding). This mixing of deferent colors of inks results in deterioration of a print quality.

On the other hand, there are known methods for increasing the optical density of the image or decreasing the bleeding, which apply a liquid for making the coloring materials such as a dye or a pigment insoluble (referred to as a reacting liquid in the present specification) prior to applying ink. For example, Japanese Patent Application Laid-open No. 5-202328 (1993) proposes a method for preventing the bleeding by using the reaction between the polyvalent metal ion and the carboxyl group; further, Japanese Patent Application Laid-open No. 9-207424 (1997) proposes a method for reducing the bleeding by means of the reaction among the pigment, resin emulsion and polyvalent metallic salt.

Further, there are some proposals for the method for using the reacting liquid and the ink and carrying out the efficient printing by sequentially applying the reacting liquid and the ink. For instance, Japanese Patent Application Laid-open No. 7-195823 (1995) describes a method in which printing is performed by ejecting the reacting liquid and the ink in this order, during a single scan (hereinafter may be also referred to as 1 pass). Besides, there is another known method wherein, for speeding up printing, the above described printing during 1-pass is performed during each of bidirectional two scans with the printing head (hereinafter also referred to as a bidirectional printing). Further, as illustrated in FIG. 6, the 1-pass and bidirectional printing is commonly performed so that printing for a single scanning area is completed during the single scan with the printing head, and this printing during the 1-pass is made to take place during each of the forward scan and the backward scan with the printing head. Then, a printing medium is fed by an amount corresponding to the width of the scanning area (i.e., the width of printing by the printing head) between any one scan and another scan. In FIG. 6, the black rectangular area represents the printing head whereas the vertical length thereof represents the width of the printing made by the printing head.

However, in the case of the bidirectional printing method, in applying the reacting liquid and the ink on the printing medium overlapping with each other, the order of applying the reacting liquid and the ink during the forward scan is reverse to that during the backward scan, thereby possibly causing the occurrence of uneven coloring and resultant deterioration of the printing quality due to the bidirectional printing process.

FIG. 1A and FIG. 1B are diagrams schematically illustrating the condition described above. As shown in FIG. 1A, the arrangement of the printing heads for the inks, i.e., cyan (C), magenta (M), yellow (Y), black (K), and the reacting liquid Sp, is made so that the printing heads for the respective inks of colors are arranged along a direction of the scanning while the printing head for the reacting liquid Sp is arranged at one end of the series of printing heads for the inks. Further, in the diagram, each row of ejection orifices of the ink and the row of the reacting liquid ejection orifices are represented by the segment of straight line respectively. The same applies to the cases of other drawings referred later.

With the arrangement of the printing heads, in the case of 1-pass and bidirectional printing, for example, as shown in FIG. 1B, during the first pass of the forward scan, the overlapped application is made in the order of the reacting liquid Sp and ink M, while, during the second pass of the backward scan, the overlapped application occur in the order of the ink M and the reacting liquid Sp. In consequence, the order of the overlapped application of the ink and the reacting liquid during the forward scan differs from that during the backward scan, thereby causing the difference in the coloring between the image printed during the forward scan and the image printed during the backward scan, and then the delicate difference may be caused in the coloring of the printed image between scanning areas of the respective forward and backward scans to be unevenness coloring. Such situation is considered to result mainly from the difference in permeability to the printing medium between the reacting liquid and the ink and resultingly the amount of reacting of the reacting liquid with the ink varying depending on which of the reacting liquid and the ink is applied before the other.

In contrast, Japanese Patent Application Laid-open No.2001-138554 proposes a system wherein, as shown in FIG. 2A, the printing heads for ejecting the reacting liquid Sp are arranged symmetrically similarly to the printing heads for respective color inks (i.e., C, M and Y) so that the orders of overlapping of the ink and the reacting liquid during respective forwarding and backward scans can be made to coincide with each other. In other words, as shown in the same figure, out of the printing heads for the reacting liquid Sp, one arranged on the leftmost end and the group of the printing heads for the respective color inks arranged on the left-hand side are used together for printing during the forwarding scan, while the printing heads for the reacting liquid arranged on the rightmost end and the group of the printing heads for the respective color inks arranged on the right-hand side are used together for printing during the backward scan, whereby, as shown in FIG. 2B, it can be made possible for the reacting liquid Sp to be applied always in first during any of the forward and the backward scans, and, subsequently, any one of inks C, M, Y or two or three different color inks can be applied in the order of C, M and Y.

However, arranging the printing heads for the reacting liquid in addition to the printing heads for the respective color inks symmetrically with one another causes an increase in the number of printing heads and then causes an increase in the size of an apparatus using the printing heads and the manufacturing cost for the apparatus. Further, even if printing heads are configured so that printing heads for respective inks are recognized by a row of ejection orifices and are of chip forms which are integrated as one unit, such a system also causes an increase in the unit size and then causes an increase in the size of the apparatus. Further, the increase in the number of the printing head or the number of the chips in the fashion described above requires recovery units such as the caps, blades or the like being provided according to the printing heads, and then brings an increase in the size of the apparatus, the complication of the system of the apparatus and the increase in the manufacturing cost.

Further, the arrangements of the printing heads shown in FIG. 1A and FIG. 2A respectively are designed so that the printing heads for ejecting the ink and the printing heads for ejecting the reacting liquid are arranged on a common scanning line. Thus, such printing head arrangement is apt to give rise to a problem such that bounce mists are caused when the reacting liquid ejected and landed to a printing medium, and that the mists of the reacting liquid adheres to ejection orifice surfaces of the printing heads for inks to form insoluble substances resulting from the reaction of the reacting liquid with the ink, which provides an adverse effect on the ejection of the ink.

As the system for reducing the problem relating to the increase in the size of the printing head unit and the like, Japanese Patent Application Laid-open No.2001-138554 discloses a printing head arrangement in which the row of the reacting liquid ejection orifices is arranged to be shifted along a feeding direction of a printing medium (hereinafter referred to as a sub-scan direction) from rows of the ink ejection orifices.

FIG. 3A shows an example of such arrangement of the printing heads. In the system shown in the same figure, the respective rows of the ejection orifices for respective inks C, M and Y are arranged symmetrically with respect to the row of the ejection orifices for ink K, while the row of the ejection orifices for the reacting liquid Sp is arranged adjacent to the endmost row of the ink ejection orifices in the sub-scan direction (a sheet feeding direction). Further, the length of each row of the ink ejection orifices is set equal to the length of the row of the reacting liquid ejection orifices. According to this arrangement, as shown in FIG. 3B, in each scanning area, the reacting liquid is applied precedently by 1 pass to that inks are applied (i.e. during the $0^{th}$ scan prior to the first scan for the ink; during the second scan prior to the first scan for the reacting liquid; during the third scan prior to the second scan for the reacting liquid and so on). More specifically, the inks are landed on the reacting liquid deposited during the scan preceding by 1 pass, and then the ink and the reacting liquid react with each other on the printing medium.

According to this arrangement, an order in which the reacting liquid and the ink overlap with each other can be kept constant regardless of the direction of scan as well as different scanning areas can be assigned to the reacting liquid to be ejected and the ink is to be ejected, whereby the effect of the mist of the reacting liquid can be reduced.

However, in performing printing during 1 pass by using the vertically arranged printing heads as are shown in FIG. 3A, when the difference in permeability between the ink and the reacting liquid is relatively large, such difference in the permeability may cause insufficient coloring in the vicinity of the boundary of the adjacent scanning areas, and then an printed image has white streaks throughout the whole printed image.

More specifically, in the case shown in FIG. 3B, if the permeability of the ink to be applied over the previously applied reacting liquid is higher than the permeability of such reacting liquid, the reacting liquid, which has been deposited on the printing medium preceding by 1 pass to the deposit of the ink, will be mixed to some extent with the ink, which has been deposited simultaneously with the reacting liquid during the same scan (i.e., the first scan, the second scan and whatever), in a hatched vicinity area of a boundary for the adjacent scanning area (on the right-hand side in the figure), and, as a result, the permeability of the reacting liquid mixed with the ink increases. Then, before the ink is applied in the following scans (i.e., the second scan, the third scan and whatever), the reacting liquid in the vicinity area marked with the hatching permeates a printing medium more than the reacting liquid in an area other than area marked with the hatching. In consequence, an amount of reacting of the ink with the reacting liquid in the hatched area decreases and then solubilization or coagulation of the coloring substance in the ink becomes insufficient, so that the marked area with the hatching has a lower optical density than that of the area other than the marked area. Then, the area having lower optical density can cause the problems such as the development of white streaks in the printed image.

Here, the cause of the phenomenon called the white streaks will be discussed specifically. Here, the discussion will be confined to the scanning area X, wherein the reacting liquid is applied during the first scan while the high-permeability ink is applied during the second scan (i.e., the area wherein the area 1 for application of the reacting liquid and the area 2 for application of the ink overlap with each other) and the scanning area Y, wherein the low-permeability reacting liquid is applied during the second scan while the high-permeability ink is applied during the third scan (i.e., the area wherein the area 2 for application of the reacting liquid and the area 3 for application of the high-permeability ink overlap with each other). Within the scanning area Y, the ink applied during the third scan reacts with the reacting liquid applied during the preceding second scan. In this arrangement, since the major portion (indicated as the non-hatched portion in the figure) of the scanning area Y is covered with the low-permeability reacting liquid, a sufficient amount of reacting liquid remain near the surface of the printing medium throughout the scanning area Y. Therefore, within the major portion (indicated as a non-hatched portion in the figure) of the scanning area Y, the ink and the reacting liquid can react sufficiently with each other to provide a sufficient optical density. However, the reacting liquid present within the portion indicated as the hatched portion in the figure of the scanning area Y has been mixed to some extent with the ink applied within the scanning area X during the second scan prior to application of the ink during the third scan, so that the permeability of the reacting liquid has been increased. In consequence, at the time of the third scan for application of the ink, the reacting liquid applied on the hatched area of the scanning area Y has already permeated into the printing medium to some extent. Consequently, the amount of the reacting liquid remaining near the surface of the printing medium within the hatched area (i.e., the amount of the reacting liquid for enabling the reaction with the ink to be applied during the third scan) becomes relatively small compared with the reacting liquid present within non-hatched area. In such a situation, the optical density of the hatched area becomes lower than that in the non-hatched area thereby causing the development of the white streak.

DISCLOSURE OF THE INVENTION

The object of the present invention is to provide an ink-jet printing method and an ink-jet printing apparatus capable of reducing a non-uniformity of color, including white streaks, occurring in the process of printing by using a vertically arranged heads designed for respectively ejecting ink and a reacting liquid.

In the first aspect of the present invention, there is provided an ink jet printing method of performing printing by repeating a scanning step for scanning a row of ink ejection orifices for ejecting ink and a row of reacting liquid ejection orifices for ejecting a reacting liquid that reacts with the ink, across a printing medium, in order to eject the ink and the reacting liquid onto the printing medium, and a feeding step for feeding the printing medium, wherein the scanning step performs the scan of the row of ink ejection orifices and the row of reacting liquid ejection orifices, so that a scanning area of the ink to which the ink is ejected while the row of ink ejection orifices scans and a scanning area of the reacting liquid to which the reacting liquid is ejected while the row of reacting liquid ejection orifices scans are adjacent to each other in a feeding direction of the printing medium, and, among the ink and the reacting liquid that have different permeability, a width of the scanning area of a liquid having relatively high permeability along the feeding direction is made longer than that of the scanning area of a liquid having relatively low permeability, or a width of the scanning area of a liquid having relatively high permeability along the feeding direction is made equal to that of the scanning area of a liquid having relatively low permeability, the feeding step feeds the printing medium, by an amount corresponding to a width which is shorter than the width of the scanning area of the liquid having relatively high permeability by a predetermined amount, and in a direction so that the liquid having relatively high permeability is ejected over the liquid having relatively low permeability, and at least for the liquid having relatively high permeability, ejection of the liquid onto a first scanning area, which corresponds to a width of the predetermined amount within the scanning area of the liquid, is performed during two times of scan, and ejection of the liquid onto a second scanning area other than the first scanning area, within the scanning area of the liquid, is performed during a single scan.

In the second aspect of the present invention, there is provided an ink jet printing method of performing printing by repeating a scanning step for scanning a row of ink ejection orifices for ejecting ink having a predetermined permeability and a row of reacting liquid ejection orifices for ejecting a reacting liquid that has lower permeability than the predetermined permeability of the ink and reacts with the ink, across a printing medium, in order to eject the ink and the reacting liquid onto the printing medium, and a feeding step for feeding the printing medium, wherein the scanning step performs the scan of the row of ink ejection orifices and the row of reacting liquid ejection orifices, so that a scanning area of the ink ejection orifices to which the ink is ejected while the row of ink ejection orifices scans and a scanning area of the reacting liquid ejection orifices to which the reacting liquid is ejected while the row of reacting liquid ejection orifices scans are adjacent to each other in a feeding direction of the printing medium, and a width of the scanning area of the reacting liquid ejection orifices along the feeding direction is made shorter than that of the scanning area of the ink ejection orifices by a predetermined amount, the feeding step feeds the printing medium by an amount corresponding to the width of the scanning area of the reacting liquid ejection orifices, the row of reacting liquid ejection orifices is located at an upstream side of the row of ink ejection orifices in the feeding direction so that the scanning area of the ink ejection orifices and the scanning area of the reacting liquid ejection orifices are made adjacent to each other in the feeding direction in the same scan, and ejection of the ink onto a first scanning area, which corresponds to a width of the predetermined amount within the scanning area of the ink ejection orifices, is performed during two times of scan, and ejection of the ink onto a second scanning area other than the first scanning area, within the scanning area of the ink ejection orifices, is performed during a single scan.

In the third aspect of the present invention, there is provided an ink jet printing method comprising:

a providing step for providing a printing head in which a row of (n) ink ejection orifices for ejecting ink having a predetermined permeability and a row of (n−a) reacting liquid ejection orifices for ejecting a reacting liquid that has lower permeability than the predetermined permeability of the ink and reacts with the ink are arranged to be adjacent to each other in an array direction of the orifices;

a scanning step for scanning the printing head in a different direction from the array direction across a printing medium so that a scanning area of the reacting liquid ejection orifices, which has a width corresponding to the (n−a) orifices, and a scanning area of the ink ejection orifices, which has a width corresponding to the (n) ink ejection orifices are adjacent to each other during a single scan; and a feeding step for feeding the printing medium in a direction perpendicular to the direction of scanning by a width corresponding to the (n−a) ejection orifices, between successive two scanning by the scanning step, wherein ejection of the reacting liquid onto the scanning area of the reacting liquid ejection orifices is performed during a single scan, and within the scanning area of the ink ejection orifices, ejection of the ink onto the respective scanning areas, each of which has a width corresponding to (a) ejection orifices and which are located at respective end portions of the row of ink ejection orifices, is performed during two times of scan, and ejection of the ink onto a scanning area, which has a width corresponding to (n−a) ejection orifices and is not located at the end portion, is performed during a single scan.

In the fourth aspect of the present invention, there is provided an ink jet printing method comprising:

a providing step for providing a printing head in which a row of (n) ink ejection orifices for ejecting ink having a predetermined permeability and a row of (n−a) reacting liquid ejection orifices for ejecting a reacting liquid that has lower permeability than the predetermined permeability of the ink and reacts with the ink are arranged to be adjacent to each other in an array direction of the orifices;

a scanning step for scanning the printing head in a different direction from the array direction across a printing medium so that a scanning area of the reacting liquid ejection orifices, which has a width corresponding to the (n−a) orifices, and a scanning area of the ink ejection orifices, which has a width corresponding to the (n) ink ejection orifices are adjacent to each other during a single scan; and a feeding step for feeding the printing medium in a direction perpendicular to the direction of scanning by a width corresponding to the (n−a) ejection orifices, between successive two scanning by the scanning step, wherein, during a single scan by the scanning step, ejection of the reacting liquid onto the scanning area of the reacting liquid ejection orifices is performed at a printability duty of 100%, and within the scanning area of the ink ejection orifices, ejection of the ink onto the respective scanning areas, each of which has a width corresponding to (a) ejection orifices and which are located at respective end portions of the row of ink ejection orifices, is performed at the printability duty of less than 100%, and ejection of the ink onto a scanning area, which has a width corresponding to (n−a) ejection orifices and is not located at the end portion, is performed at the printability duty of 100%.

In the fifth aspect of the present invention, there is provided an ink jet printing method of performing printing by repeating a scanning step for scanning a row of ink ejection orifices for ejecting ink having a predetermined permeability and a row of reacting liquid ejection orifices for ejecting a reacting liquid that has lower permeability than the predetermined permeability of the ink and reacts with the ink, across a printing medium, in order to eject the ink and the reacting liquid onto the printing medium, and a feeding step for feeding the printing medium, wherein the scanning step performs the scan of the row of ink ejection orifices and the row of reacting liquid ejection orifices, so that a scanning area of the ink ejection orifices to which the ink is ejected while the row of ink ejection orifices scans and a scanning area of the reacting liquid ejection orifices to which the reacting liquid is ejected while the row of reacting liquid ejection orifices scans are adjacent to each other in a feeding direction of the printing medium, and a width of the scanning area of the reacting liquid ejection orifices along the feeding direction is made equal to that of the scanning area of the ink ejection orifices, the feeding step feeds the printing medium by an amount corresponding to a width, which is shorter than the respective widths of the scanning areas of the ink ejection orifices and the reacting liquid ejection orifices by a predetermined amount, the row of reacting liquid ejection orifices is located at a upstream side of the row of ink ejection orifices in the feeding direction so that the scanning area of the ink ejection orifices and the scanning area of the reacting liquid ejection orifices are made adjacent to each other in the feeding direction in the same scan, and ejection of the ink and the reacting liquid onto a first scanning area, which corresponds to a width of the predetermined amount within the respective scanning areas of the ink ejection orifices and the reacting liquid ejection orifices, is performed during two times of scan, and ejection of the ink and the reacting liquid onto a second scanning area other than the first scanning area, within the respective scanning areas of the ink ejection orifices and the reacting liquid ejection orifices, is performed during a single scan.

In the sixth aspect of the present invention, there is provided an ink jet printing method comprising:

a providing step for providing a printing head in which a row of (n) ink ejection orifices for ejecting ink having a predetermined permeability and a row of (n) reacting liquid ejection orifices for ejecting a reacting liquid that has lower permeability than the predetermined permeability of the ink and reacts with the ink are arranged to be adjacent to each other in an array direction of-the orifices;

a scanning step for relatively scanning the printing head in a different direction from the array direction across a printing medium so that a scanning area of the reacting liquid ejection orifices, which has a width corresponding to the (n) orifices, and a scanning area of the ink ejection orifices, which has a width corresponding to the (n) ink ejection orifices are adjacent to each other during a single scan; and a feeding step for feeding the printing medium in a direction perpendicular to the direction of scanning by a width corresponding to the (n−a) ejection orifices, between successive two scanning by the scanning step, wherein, within the scanning area of the ink ejection orifices and the reacting liquid ejection orifices, ejection of the ink and the reacting liquid onto the respective scanning areas, each of which has a width corresponding to (a) ejection orifices and which are located at respective end portions of the respective rows of ink and reacting liquid ejection orifices, is performed during two times of scan, and ejection of the ink and the reacting liquid onto a scanning area, which has a width corresponding to (n−a) ejection orifices and is not located at the end portion, is performed during a single scan.

In the seventh aspect of the present invention, there is provided an ink jet printing method comprising:

a providing step for providing a printing head in which a row of (n) ink ejection orifices for ejecting ink having a predetermined permeability and a row of (n) reacting liquid ejection orifices for ejecting a reacting liquid that has lower permeability than the predetermined permeability of the ink and reacts with the ink are arranged to be adjacent to each other in an array direction of the orifices;

a scanning step for relatively scanning the printing head in a different direction from the array direction across a printing medium so that a scanning area of the reacting liquid ejection orifices, which has a width corresponding to the (n) orifices, and a scanning area of the ink ejection orifices, which has a width corresponding to the (n) ink ejection orifices are adjacent to each other during a single scan; and a feeding step for feeding the printing medium in a direction perpendicular to the direction of scanning by a width corresponding to the (n−a) ejection orifices, between successive two scanning by the scanning step, wherein, within the respective scanning areas of the ink ejection orifices and the reacting liquid ejection orifices, ejection of the ink and the reacting liquid onto the respective scanning areas, each of which has a width corresponding to (a) ejection orifices and which are located at respective end portions of the row of ink and reacting liquid ejection orifices, is performed at the printability duty of less than 100%, and ejection of the ink and the reacting liquid onto a scanning area, which has a width corresponding to (n−a) ejection orifices and is not located at the end portion, is performed at the printability duty of 100%.

In the eighth aspect of the present invention, there is provided an ink jet printing apparatus comprising scanning means for scanning a row of ink ejection orifices for ejecting ink and a row of reacting liquid ejection orifices for ejecting a reacting liquid that reacts with the ink, across a printing medium, in order to eject the ink and the reacting liquid onto the printing medium, and feeding means for feeding the printing medium, and repeating the scanning and the feeding to perform printing, wherein the scanning means performs the scan of the row of ink ejection orifices and the row of reacting liquid ejection orifices, so that a scanning area of the ink to which the ink is ejected while the row of ink ejection orifices scans and a scanning area of the reacting liquid to which the reacting liquid is ejected while the row of reacting liquid ejection orifices scans are adjacent to each other in a feeding direction of the printing medium, and, among the ink and the reacting liquid that have different permeability, a width of the scanning area of a liquid having relatively high permeability along the feeding direction is made longer than that of the scanning area of a liquid having relatively low permeability, or a width of the scanning area of a liquid having relatively high permeability along the feeding direction is made equal to that of the scanning area of a liquid having relatively low permeability, the feeding means feeds the printing medium, by an amount corresponding to a width which is shorter than the width of the scanning area of the liquid having relatively high permeability by a predetermined amount, and in a direction so that the liquid having relatively high permeability is ejected over the liquid having relatively low permeability, and at least for the liquid having relatively high permeability, ejection of the liquid onto a first scanning area, which corresponds to a width of the predetermined amount within the scanning area of the liquid, is performed during two times of scan, and ejection of the liquid onto a second scanning area other than the first scanning area, within the scanning area of the liquid, is performed during a single scan.

In the ninth aspect of the present invention, there is provided an ink jet printing apparatus comprising scanning means for scanning a row of ink ejection orifices for ejecting ink having a predetermined permeability and a row of reacting liquid ejection orifices for ejecting a reacting liquid that has lower permeability than the predetermined permeability of the ink and reacts with the ink, across a printing medium, in order to eject the ink and the reacting liquid onto the printing medium, and feeding means for feeding the printing medium, and repeating the scanning and the feeding to perform printing, wherein the scanning means performs the scan of the row of ink ejection orifices and the row of reacting liquid ejection orifices, so that a scanning area of the ink ejection orifices to which the ink is ejected while the row of ink ejection orifices scans and a scanning area of the reacting liquid ejection orifices to which the reacting liquid is ejected while the row of reacting liquid ejection orifices scans are adjacent to each other in a feeding direction of the printing medium, and a width of the scanning area of the reacting liquid ejection orifices along the feeding direction is made shorter than that of the scanning area of the ink ejection orifices by a predetermined amount, the feeding means feeds the printing medium by an amount corresponding to the width of the scanning area of the reacting liquid ejection orifices, the row of reacting liquid ejection orifices is located at an upstream side of the row of ink ejection orifices in the feeding direction so that the scanning area of the ink ejection orifices and the scanning area of the reacting liquid ejection orifices are made adjacent to each other in the feeding direction in the same scan, and ejection of the ink onto a first scanning area, which corresponds to a width of the predetermined amount within the scanning area of the ink ejection orifices, is performed during two times of scan, and ejection of the ink onto a second scanning area other than the first scanning area, within the scanning area of the ink ejection orifices, is performed during a single scan.

In the tenth aspect of the present invention, there is provided an ink jet printing apparatus using a printing head in which a row of (n) ink ejection orifices for ejecting ink having a predetermined permeability and a row of (n−a) reacting liquid ejection orifices for ejecting a reacting liquid that has lower permeability than the predetermined permeability of the ink and reacts with the ink are arranged to be adjacent to each other in an array direction of the orifices and ejects the ink and the reacting liquid onto a printing medium, to perform printing, the apparatus comprising:

scanning means for scanning the printing head in a different direction from the array direction across a printing medium so that a scanning area of the reacting liquid ejection orifices, which has a width corresponding to the (n−a) orifices, and a scanning area of the ink ejection orifices, which has a width corresponding to the (n) ink ejection orifices are adjacent to each other during a single scan; and feeding means for feeding the printing medium in a direction perpendicular to the direction of scanning by a width corresponding to the (n−a) ejection orifices, between successive two scanning by the scanning means, wherein ejection of the reacting liquid onto the scanning area of the reacting liquid ejection orifices is performed during a single scan, and within the scanning area of the ink ejection orifices, ejection of the ink onto the respective scanning areas, each of which has a width corresponding to (a) ejection orifices and which are located at respective end portions of the row of ink ejection orifices, is performed during two times of scan, and ejection of the ink onto a scanning area, which has a width corresponding to (n−a) ejection orifices and is not located at the end portion, is performed during a single scan.

In the eleventh aspect of the present invention, there is provided an ink jet printing apparatus using a printing head in which a row of (n) ink ejection orifices for ejecting ink having a predetermined permeability and a row of (n−a) reacting liquid ejection orifices for ejecting a reacting liquid that has lower permeability than the predetermined permeability of the ink and reacts with the ink are arranged to be adjacent to each other in an array direction of the orifices and ejects the ink and the reacting liquid onto a printing medium, to perform printing, the apparatus comprising:

scanning means for scanning the printing head in a different direction from the array direction across a printing medium so that a scanning area of the reacting liquid ejection orifices, which has a width corresponding to the (n−a) orifices, and a scanning area of the ink ejection orifices, which has a width corresponding to the (n) ink ejection orifices are adjacent to each other during a single scan; and feeding means for feeding the printing medium in a direction perpendicular to the direction of scanning by a width corresponding to the (n−a) ejection orifices, between successive two scanning by the scanning means, wherein, during a single scan by the scanning step, ejection of the reacting liquid onto the scanning area of the reacting liquid ejection orifices is performed at a printability duty of 100%, and within the scanning area of the ink ejection orifices, ejection of the ink onto the respective scanning areas, each of which has a width corresponding to (a) ejection orifices and which are located at respective end portions of the row of ink ejection orifices, is performed at the printability duty of less than 100%, and ejection of the ink onto a scanning area, which has a width corresponding to (n−a) ejection orifices and is not located at the end portion, is performed at the printability duty of 100%.

In the twelfth aspect of the present invention, there is provided an ink jet printing apparatus comprising scanning means for scanning a row of ink ejection orifices for ejecting ink having a predetermined permeability and a row of reacting liquid ejection orifices for ejecting a reacting liquid that has lower permeability than the predetermined permeability of the ink and reacts with the ink, across a printing medium, in order to eject the ink and the reacting liquid onto the printing medium, and feeding means for feeding the printing medium and repeating the scanning and the feeding to perform printing, wherein the scanning,means performs the scan of the row of ink ejection orifices and the row of reacting liquid ejection orifices, so that a scanning area of the ink ejection orifices to which the ink is ejected while the row of ink ejection orifices scans and a scanning area of the reacting liquid ejection orifices to which the reacting liquid is ejected while the row of reacting liquid ejection orifices scans are adjacent to each other in a feeding direction of the printing medium, and a width of the scanning area of the reacting liquid ejection orifices along the feeding direction is made equal to that of the scanning area of the ink ejection orifices, the feeding means feeds the printing medium by an amount corresponding to a width, which is shorter than the respective widths of the scanning areas of the ink ejection orifices and the reacting liquid ejection orifices by a predetermined amount, the row of reacting liquid ejection orifices is located at an upstream side of the row of ink ejection orifices in the feeding direction so that the-scanning area of the ink ejection orifices and the scanning area of the reacting liquid ejection orifices are made adjacent to each other in the feeding direction in the same scan, and ejection of the ink and the reacting liquid onto a first scanning area, which corresponds to a width of the predetermined amount within the respective scanning areas of the ink ejection orifices and the reacting liquid ejection orifices, is performed during two times of scan, and ejection of the ink and the reacting liquid onto a second scanning area other than the first scanning area, within the respective scanning areas of the ink ejection orifices and the reacting liquid ejection orifices, is performed during a single scan.

In the thirteenth aspect of the present invention, there is provided an ink jet printing apparatus using a printing head in which a row of (n) ink ejection orifices for ejecting ink having a predetermined permeability and a row of (n) reacting liquid ejection orifices for ejecting a reacting liquid that has lower permeability than the predetermined permeability of the ink and reacts with the ink are arranged to be adjacent to each other in an array direction of the orifices and ejects the ink and the reacting liquid onto a printing medium, to perform printing, the apparatus comprising:

scanning means for relatively scanning the printing head in a different direction from the array direction across a printing medium so that a scanning area of the reacting liquid ejection orifices, which has a width corresponding to the (n) orifices, and a scanning area of the ink ejection orifices, which has a width corresponding to the (n) ink ejection orifices are adjacent to each other during a single scan; and feeding means for feeding the printing medium in a direction perpendicular to the direction of scanning by a width corresponding to the (n−a) ejection orifices, between successive two scanning by the scanning means, wherein, within the scanning area of the ink ejection orifices and the reacting liquid ejection orifices, ejection of the ink and the reacting liquid onto the respective scanning areas, each of which has a width corresponding to (a) ejection orifices and which are located at respective end portions of the respective rows of ink and reacting liquid ejection orifices, is performed during two times of scan, and ejection of the ink and the reacting liquid onto a scanning area, which has a width corresponding to (n−a) ejection orifices and is not located at the end portion, is performed during a single scan.

In the fourteenth aspect of the present invention, there is provided an ink jet printing apparatus using a printing head in which a row of (n) ink ejection orifices for ejecting ink having a predetermined permeability and a row of (n) reacting liquid ejection orifices for ejecting a reacting liquid that has lower permeability than the predetermined permeability of the ink and reacts with the ink are arranged to be adjacent to each other in an array direction of the orifices and ejects the ink and the reacting liquid onto a printing medium, to perform printing, the apparatus comprising:

scanning means for relatively scanning the printing head in a different direction from the array direction across a printing medium so that a scanning area of the reacting liquid ejection orifices, which has a width corresponding to the (n) orifices, and a scanning area of the ink ejection orifices, which has a width corresponding to the (n) ink ejection orifices are adjacent to each other during a single scan; and feeding means for feeding the printing medium in a direction perpendicular to the direction of scanning by a width corresponding to the (n−a) ejection orifices, between successive two scanning by the scanning means, wherein, within the respective scanning areas of the ink ejection orifices and the reacting liquid ejection orifices, ejection of the ink and the reacting liquid onto the respective scanning areas, each of which has a width corresponding to (a) ejection orifices and which are located at respective end portions of the row of ink and reacting liquid ejection orifices, is performed at the printability duty of less than 100%, and ejection of the ink and the reacting liquid onto a scanning area, which has a width corresponding to (n−a) ejection orifices and is not located at the end portion, is performed at the printability duty of 100%.

According to the above configuration, an amount of permeation of the low-permeability liquid (e.g., the reacting liquid), which is induced by the high-permeability liquid (e.g., the ink), into the printing medium can be reduced. Thereby, when the high-permeability liquid (e.g., the ink) is ejected over the low-permeability liquid (e.g., the reacting liquid) during next scan, a degree of decrease in an amount of reacting between the ink and the reacting liquid in the vicinity of the boundary can be reduced to aid a satisfactory development of color.

As a result, it becomes possible to reduce the non-uniformity of color, including the white streaks, caused by the ink or the reacting liquid whichever having relatively lower permeability at the vicinity of a boundary of the adjacent scanning areas for the ink or the reacting liquid whichever having a lower permeability.

The above and other objects, effects, features and advantages of the present invention will become more apparent from the following description of embodiments thereof taken in conjunction with the accompanying drawings.

BRIEF DESCRIPTION OF THE DRAWINGS

FIG. 3A is a diagram showing an example of an arrangement of a vertically arranged heads, while

FIG. 5A is a diagram schematically showing an arrangement of the printing heads for the ink and the printing heads for the reacting liquid, while FIG. 5B is a diagram schematically showing a partial section of a so-called solid image as being an example of an image formed by scanning with each of the printing heads shown in FIG. 5A viewed from the direction of the scanning, and FIG. 5C is a view schematically showing a fashion wherein the reacting liquid and the ink are applied during each scan in terms of the positional relationship between each row of ejection orifices and a printing sheet;

FIG. 8A is a diagram schematically showing an arrangement of the printing heads for the ink and the reacting liquid according to the second embodiment of the present invention;

FIG. 8B is a diagram schematically showing a partial section of a so-called solid image viewed from the direction of the scanning as being an example of the image formed by the scanning with each of the printing heads shown in FIG. 8A;

FIG. 8C is a diagram schematically showing the fashion wherein the reacting liquid and the ink are applied during each scan in terms of the positional relationship between each row of ejection orifices and a sheet for printing.

BEST MODE FOR CARRYING OUT THE INVENTION

Figure 1A:
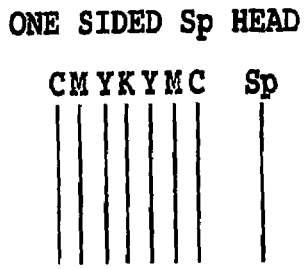
FIG. 1A and FIG. 1B are diagrams schematically showing a condition wherein the unevenness in coloring of the printed image occurs when an order of application of a reacting liquid and application of ink on a printing medium to be made overlapping with each other in a bidirectional printing system, consisting of the forward scan and the backward scan, is reversed.
Figure 1B:
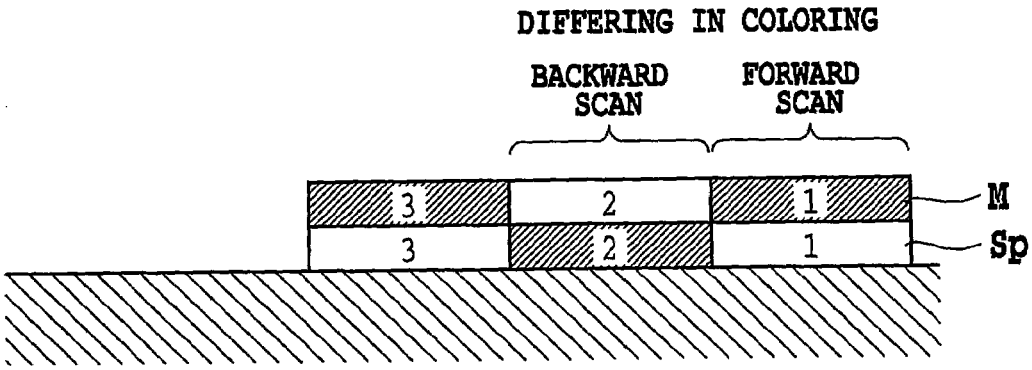
Figure 2A:
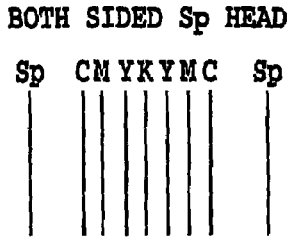
FIG. 2A and FIG. 2B are diagrams respectively showing a system wherein the printing heads for ejecting the reacting liquid are symmetrically arranged with other similar printing heads so as to assimilate the order of the overlapping of the ink and the reacting liquid during the forward scanning with that during the backward scanning.
Figure 2B:
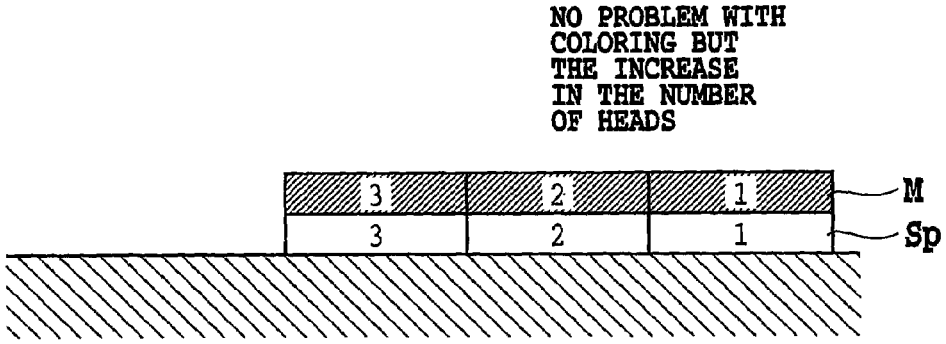

Described hereunder in detail referring to the pertinent drawings are the embodiments of the present invention.

It should be noted that, in the present specification, a description, "there is a difference in a permeability between ink and a reacting liquid" means that the permeability of the ink to the printing medium differs from that of the reacting liquid to the printing medium. Then, out of the ink and the reacting liquid, anyone having a relatively higher permeation rate to the printing medium is defined as a high permeability while the other having a relatively low permeation rate is defined as a low permeability. Thus, if the ink has a higher permeation rate to the printing medium than the reacting liquid, the reacting liquid is of the low permeability and the ink is of the high permeability. On the other hand, if the permeation rate of the ink to the printing medium is lower than that of the reacting liquid, the reacting liquid is of the high permeability and the ink is of low permeability. Further, in the present embodiment, the ink having a relatively high permeation rate is hereinafter referred to as a high-permeability ink, while the reacting liquid having a relatively low permeation rate is hereinafter referred to as a low-permeability reacting liquid.

Here, the permeation rate of the ink will be discussed briefly. Also, the similar discussion will be made as to the reacting liquid too.

It is known that, where the permeability of the ink defined, for example, in terms of the amount V per 1 $m^2$, the permeation amount V (Unit: $ml/m^2=\mu m$) of the ink after the laps of the time t from the ejection of the ink can be expressed by Bristow formula as is given below.

$$V=Vr+Ka(t-tw)^{1/2}$$

where Lt>tw.

The ink drop, immediately after being dropped onto the surface of the printing paper, is known to be absorbed only among the convexes and concaves forming the surface roughness of the printing paper and is hardly absorbed into the printing paper. This time interval (required for the settlement of the ink) is defined as tw (wetting time), and the amount of absorption into the convex and concave (surface) areas of the printing paper during this time interval is defined as the amount of absorption Vr. When the lapse of the time following the drop of the ink exceeds tw, the permeation amount V increases proportionally to $1/2^{nd}$ power of the time exceeded, i.e., (t−tw). Ka represents the factor of proportionality of the increment (of the time) and varies according to the permeation rate.

In general, the greater the value of Ka, the greater the permeability, whereas the smaller the value of Ka, the smaller the permeability. Further, the value of Ka can be varied by using the known methods such as those characterized by varying the ratio of the content of the ethylene oxide.2, 4,7,9-tetramethyl-5.decyne-4,7-diol (hereinafter referred to as Acetylenol (Brand name) of the product of Kawaken Fine Chemicals Co., Ltd.); more particularly, increasing the content of the Acetylenol in the ink causes the value of Ka to increase and the resultant increase in permeability thereof. For reference, the permeability (of the ink) can be varied not only by varying the content of the Acetylenol but also by varying the content of the surface active agents other than the Acetylenol, such as the Surfynol (the brand name of the product of Air Product Japan), or by varying the kind or the content of the organic solvent in the ink or the acting liquid.

For reference, the value of Ka can be measured by using the dynamic permeability testing apparatus S for the liquids (manufactured by Toyo Seiki Seisakusho) designed based on the Bristow method.

First Embodiment

Figure 4:
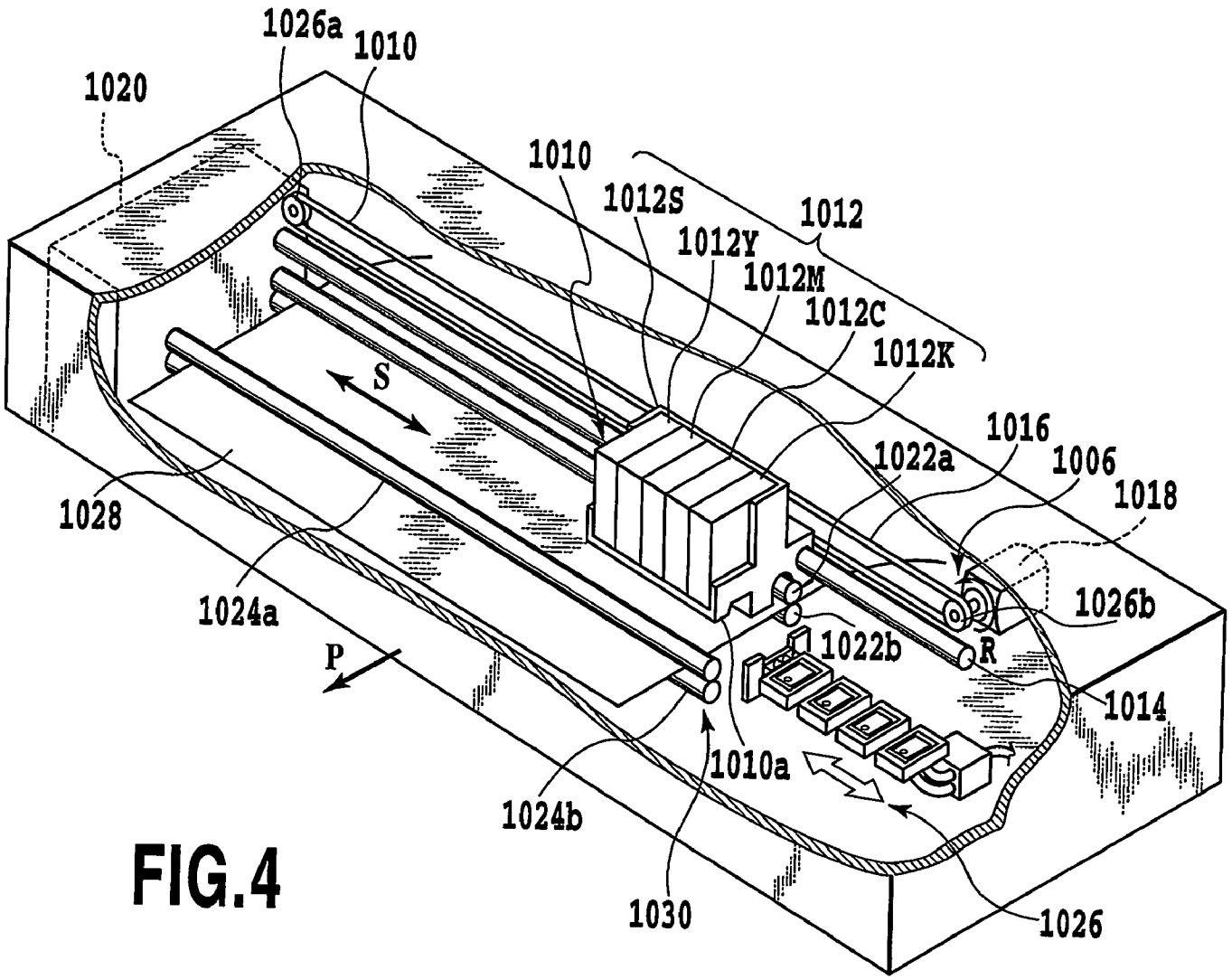
FIG. 4 is a perspective view schematically showing a composition of an ink-jet printer as an embodiment of the present invention relating to the ink-jet printing apparatus.

FIG. 4 is a perspective view schematically showing the construction of an ink-jet printer as an embodiment of an ink-jet printing apparatus according to the present invention.

As seen from FIG. 4, in an ink-jet printer according to the present embodiment, a feeding mechanism 1030 is provided in a casing 1020 along the longitudinal direction thereof, whereby the printing sheet 1028 as a printing medium, can be fed intermittently by an amount of feeding, as is described later by being related with FIGS. 5A-5C, in the direction as is indicated by an arrow shown in FIG. 4. The feeding mechanism 1030 comprises a pair of a paper ejecting roller 1024*a* and a spur 1024*b*, a pair of feeding rollers 1022*a* and 1022*b*, and a feeding motor or the like for driving these pairs of the rollers.

A guide shaft 1014, being substantially perpendicular to the feeding directions P of the sheet 1026, is provided in a direction of an arrow S shown in the figure and a carriage 1010*a* is provided to be movable along the guide shaft. The carriage 1010*a* is detachably mounted with a head unit (not shown), the head unit being integrally mounted with the head chips for a plurality of kinds of ink and a reacting liquid and cartridges 1012S, 1012Y, 1012M, 1012C and 1012K containing corresponding inks and the reacting liquid to be supplied to the corresponding head chips. In the head unit, the head chips, for serving as the printing heads, are provided with the rows of the ejection orifices for ejecting the corresponding inks or the reacting liquid, the rows of the ejection orifices being arranged in a predetermined relationship which will be described later in FIG. 5A. Each of the head chips, corresponding to the respective inks and the reacting liquid, are provided with an electro-thermal conversion element so that thermal energy generated when the electric pulse is applied to the electro-thermal conversion element is used for letting the ink form a bubble whose pressures cause the ink to be ejected. The head unit, the cartridge 1012S or the like and the carriage 1010*a* mounted with such head unit and the cartridge 1012S, constitute a printing unit 1010. The printing unit 1010 scans the sheet 1028 in the direction of the arrow S to eject the ink and the reacting liquid from the respective ejection orifices arranged in the rows for performing printing during the scanning. As will be mentioned later referring to FIGS. 5A-5C, the present embodiment is designed basically for enabling the 1-pass printing by each printing head during each of forward scan and the backward scan accompanying bidirectional movements of the carriage. In the present embodiment, the respective inks are of the high permeability while the reacting liquids are of the low permeability.

Figure 6:
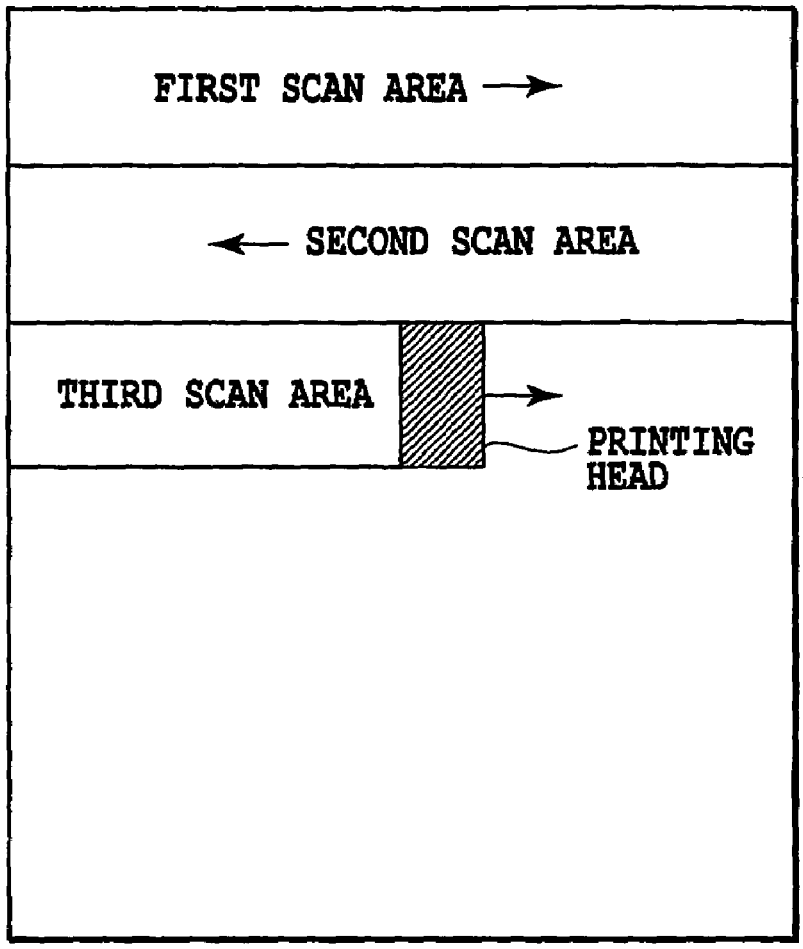
FIG. 6 is a diagram schematically illustrating a process of an 1-pass and bidirectional printing system.

Further, a general 1-pass and bidirectional printing is, as shown in FIG. 6, what completes the printing corresponding to one scanning area by a single scanning operation; more particularly, one forward scan and one backward scan are alternately repeated to complete the printing corresponding to each scanning area, and, during the interval between the scans, a printing medium is fed as much as a width of the scanning area (equivalent to the length of the printing head) in a sub-scanning direction i.e., a direction perpendicular to the direction of the scanning). More particularly, as shown in FIG. 6, the printing corresponding to the first scanning area is completed with one forward scan with the printing head as indicated by a blackened rectangular area; then, the printing medium is transferred as much as the width of the scanning area corresponding to above-mentioned single forward scan (equivalent to the length of the printing head) corresponding to one forward scan; then, the printing corresponding to the second scanning area is completed by one backward scan of the printing head; then, the printing medium is transferred as much as the width of the scanning area, corresponding to the above-mentioned one backward scan, (equivalent to the length of the ejection orifices arranged in a row).

The carriage 1010*a* is made to travel by a drive section 1006. The drive section 1006 comprises a pulley 1026*a* and a pulley 1026*b*, respectively mounted on a rotary shafts arranged at a predetermined interval corresponding to a moving area of the carriage, a belt 1016 passed over the pulleys, the part thereof being connected with the carriage 1010*a*, and a motor 1018 for moving the belt forward and backward by driving the pulley 1026*a*. When the motor 1018 is activated to cause the belt 1016 to rotate in the forward direction, the carriage 1010*a* of the printing unit is made move in one of the directions indicated by the two arrowheads of the arrow S in FIG. 4 thereby enabling the forward scan by the printing head. When the motor 1018 is activated to cause the belt 1016 to move in the backward direction, the carriage 1010*a* is made move in the direction of an arrow S, opposite to the direction of the forward movement of the belt 1016, thereby enabling the backward scan by the printing head. A point to serve as the home position of the carriage 1010*a* is defined at one end of the feeding area of the carriage 1010*a*, and a recovery unit 1026, provided with a cap or the like, is provided at such a point. In this way, an ejection recovery processing for each chip of the head unit can be made possible.

In the above configuration, as described in detail later referring to FIGS. 5A-5C, the rows of the ejection orifices constituting head chips in the head unit are arranged in a fashion that the scanning area of the reacting liquid and the scanning area of each ink are adjacent to each other in the sub-scan direction (in a feeding direction), during the same scanning operation. Hence, on the basis of each scanning area, the reacting liquid is ejected precedently by one pass (i.e., precedently by 1 scan) to ejection of the ink. More specifically, when the carriage 1010*a* moves in one direction so that the printing heads reach one end of the scanning area during the forward scan therewith, the feeding mechanism 1030 feeds the printing sheet 1028 by a length equivalent to a length of the row of reacting liquid orifices (more specifically, a length obtained by multiplying the number of orifices in the row by the pitch of the orifices in the row, or a length obtained by projecting the obtained by multiplying in the case where the row of the ejection orifices are disposed slightly inclining to the feeding direction. In the present specification, this length is referred to be the length of the row of the ejection orifices. Then, for the backward scan, the carriage 1010*a* is made travel in the direction opposite to the direction of the forward scan; during this scan, the ink ejected from each ink head chip is landed on the reacting liquid, which has previously been landed on the printing medium during the preceding scan, to react with the previously landed reacting liquid. During the same scan, the reacting liquid is ejected from the ejection orifice of the reacting liquid head chip. This ejection of the reacting liquid is ejection which is made during the scan preceding by 1 pass to the scan during which the ink is ejected to that area, and the image is formed by repeating the above-mentioned bidirectional printing operation. Further, as will be described later referring to FIGS. 5A-5C, in the present embodiment, a predetermined joint portion (boundary portion), which is vicinity portion of the boundary between scanning areas in the scanning area by the row of the ink ejecting orifices, are subjected to ink ejection during two times of scanning, and scanning area other than the joint portion in the scanning area are subjected to ink ejection during single scanning. On the other hand, the scanning area by the row of the reacting liquid ejection orifices is subjected to ejection of the reacting liquid during single scanning. However, for the front end and the rear end of the image to be printed, ejection of the ink is made during the single scan with the row of the ink ejection orifices. Further, as discussed above, for the above-mentioned joint portion, the scanning for ejection of the ink is made two times, and then a thinning-out processing is applied according to ink ejection data. For instance, in the present embodiment, a mask designed for 50% printability (printability duty) is used so that the ejection of the ink can be shared between two scans. By sharing the ejection of the ink between two scans, the amount of the ink and the amount of the reacting liquid coming into contact with each other in the boundary of the different scanning areas can be reduced as described later.

Next, one of modes of the printing operation and the process thereof based on the configuration of the present embodiment described above, will be described referring to FIGS. 5A through 5C. The printing operation and the related data processing, which will be described below, are carried out according to a control system of the previously mentioned apparatus. In other words, the control system comprises a CPU for controlling the printing operation and the related data processing, the program to be executed by the CPU, the ROM storing the data such as mask data for the thinning process, the RAM to be used as the work area for the control and the data processing by the CPU and the like in order to carry out the printing and the processing of the data which will be described in the following.

FIG. 5A is a diagram schematically illustrating the arrangement of the printing heads for the ink and the reacting liquid, wherein the rows of the ink ejection orifices and the rows of the reacting liquid are indicated by the straight lines as mentioned previously. FIG. 5B is a diagram schematically illustrating the partial section of a so-called solid image as an example of the image to be formed by the scanning with each of the printing heads shown in FIG. 5A. Besides, FIG. 5C is a diagram illustrating a way how the reacting liquid and the ink are applied during each scan in terms of a positional relationship between the rows of the ink ejection orifices and the reacting liquid ejection orifices and the printing sheet. It should be noted that, in the case of the present embodiment, the individual printing heads are in chip form and combined into a unit for use; however, the embodiments of the present invention is not limited to such form; for example, the printing heads may be used independently from one another; further, regardless of the fashion of the application, it is obvious from the following descriptions that the performance of the individual printing heads can be described in terms of the row of the ejection orifices.

In FIG. 5B, each of rectangular areas at a lower side indicates a scanning area corresponding to the row of the reacting liquid ejection orifices in each scan, the scanning area being expressed by the reacting liquid applied to whole of that area. More specifically, in the figure, each of the rectangular areas, denoted by the numeral N (N being any integer equal to or larger than 0), represents the scanning area to be covered by the N-th scan with a row of the reacting liquid ejection orifices. For instance, the rectangular area denoted by the numeral 1 is the scanning area to be covered by the first scan with the row of the reacting liquid ejection orifices. On the other hand, each of trapezoidal areas at a upper side represents a scanning area to be covered by the row of the ink ejection orifices, that scanning area being expressed by the ink applied to whole of that area. More specifically, each of the trapezoidal areas denoted by the numeral N (N being any integer equal to or larger than 0) in the figure represents the area to be scanned by the row of the ink ejection orifices. For instance, the trapezoidal area denoted by the numeral 1 represents the scanning area to be covered with the row of the ink ejection orifices in the first scan.

As shown in FIG. 5A, with respect to the different inks, C, M and Y, the rows of the ink ejection orifices are arranged on the opposite sides of an axis perpendicular to the direction of the scanning (defined as the symmetric arrangement in the present specification, but such symmetry need not necessarily be the strict linear symmetry; for instance, even the symmetric arrangement wherein the distances of the row of orifices from the axis of the symmetry may differ from one another is also permissible); further, the row of the ink ejection orifices for the ink K is arranged on a center of the symmetry arrangement. Each row of the ejection orifices comprises n number of the ejection orifices. On the other hand, the row of the ejection orifices of the reacting liquid is arranged adjacent to one row of the ink ejection orifices of ink C in the sub-scanning direction, and the number of the ejection orifices of the reacting liquid is (n−a). Here, the adjacent arrangement of the rows of the ejection orifices means the arrangement wherein the row of the ejecting orifices of ink C and the row of the reacting liquid ejection orifices are arranged apart by the distance equivalent to 1 pitch p of the ejection orifice arrangement, which is the distance between the two adjacent rows of the ejecting orifices. In the present embodiment, a common pitch P is applied equally to the row of the ink ejection orifices and the row of the reacting liquid ejection orifices.

The width of the scanning area scanned by each row of the ejection orifices is A for the row of the reacting liquid ejection orifices and is B for the row of the ink ejection orifices as shown in FIG. 5B. The width of the scanning area is dependent on the size of a dot formed by the ink or the reacting liquid ejected onto the printing medium; however, in general, the size of such dot is set to the size being large enough for enabling the ink dots or the reacting liquid dots to at least come into contact with each other without leaving any gap between the adjacent scanning areas; in the present embodiment, the size of the such dot is assumed to be equivalent to the pitch p and the value of A is set as $A=(n-a)\times p$, while the value of B is set as $B=n\times p$.

Further, an amount of the feeding of the printing sheet at the time for each scanning operation (i.e., an amount of the feeding of the printing medium between the scans) is equivalent to the width (i.e., the width of an area to which the reacting liquid is applied during the single scan) of the scanning area with the row of the reacting liquid ejection orifices, which is represented as $A=(n-a)\times x\ p$. Thus, the width A of the scanning area, to which ejection of the reacting liquid precedes, becomes smaller by $C=a\times p$ ($C=B-A$) than the width of the scanning area B for ejection of the ink during succeeding scan, whereby the scanning with the row of the ink ejection orifices is made two times within the area having the width C. In the present embodiment, the thinning process (mask process) to ink ejection data is applied to the area having the width C so that formation of the image can be completed with two scans. In this way, when a printability duty (as being the ratio of the number of the pixels, which can be made available by ejection of the ink, to the total number of pixels within a certain area, assuming that the printability is 100% where the ink is ejected only once corresponding to all the pixels within the certain area as defined in the present specification) is set as for example 50%, so that the amount of the ink to be ejected during the single scan can be reduced in the area having the width C.

Figure 7:
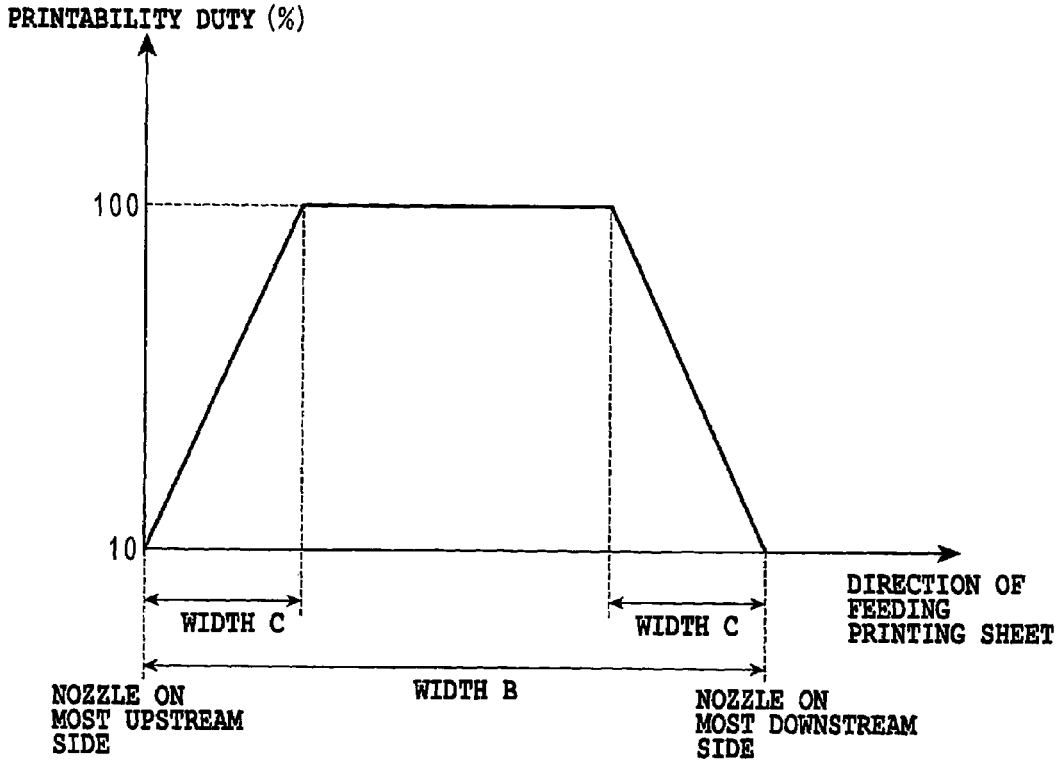
FIG. 7 is a diagram schematically illustrating a mask to be used in the first embodiment of the present invention.

In the present embodiment, regarding the area having the width C, a mask corresponding to the first scan is determined so that for each of divided areas, which is obtained by dividing the area having the width C (data for "a" pieces of the scanning lines or raster data) into 9 parts or approximately into 9 parts; the duty is made to increase gradually at the rates, i.e., 10%, 20% up to 90% within area having the width C, while the mask corresponding to the second scan is provided as a pattern being reverse to the pattern of the mask for the first scan so as to complement the formation of the dots. For the correspondence of the mask pattern with the row of the ink ejecting orifices, the mask for the first scan corresponds to the row of the ejection orifice of an end portion corresponding to the width C on the upstream side in the feeding direction of the paper sheet, while the mask for the second scan, which is made available by reversing the mask applied to the first scan with respect to the outermost row of the ejection orifice, corresponds to the row of the ejection orifices corresponding to the width C on the downstream side. Further, when viewed from different basis, the mask to be used for the scan with the row of the ink ejection orifices presents a mask of a trapezoidal shape as shown in FIG. 7. More specifically, in a single scanning, the whole row of the ink ejection orifices corresponds to the width B, while, out of the row of the ejection orifices, the respective predetermined number of the orifices on the upstream side and on the downstream side correspond to the width C respectively. Further, the printability duty of the predetermined number of the orifices corresponding to the width C is set to 10% to 90% so that the scanning for printing for the width C is divided into two times of scanning. On the other hand, the printability duty for the area other than the area having the width C is set to 100% so as to complete printing during a single scan. Further, needless to say, a mask is not needed for application of the reacting liquid, since application of the reacting liquid is completed during a single scan.

According to the system describe above, the amount of contacts that is made, during the same scan (e.g., a second scan), between the reacting liquid ejected to the vicinity of the boundary in the scanning area adjacent to the area having the width C and the ink ejected to the area having the width C, whereby the increase in the amount of the permeation of the reacting liquid resulting from coming into contact with the high-permeability ink can be reduced in the vicinity of the boundary in the scanning area adjacent to the area having the width C. As a result, in the scanning area adjacent to the area having the width C, the non-uniformity of the color resulting from the insufficient amount of reacting of the ink with the reacting liquid, such as low optical density in the vicinity of the boundary, can be reduced.

Figure 3A:
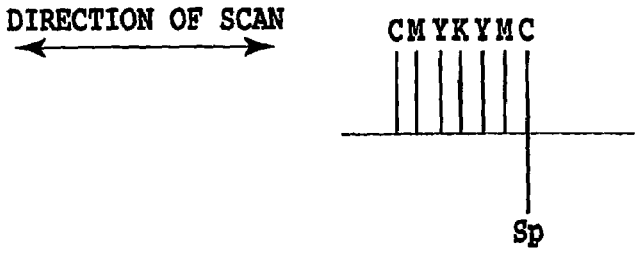
Figure 3B:
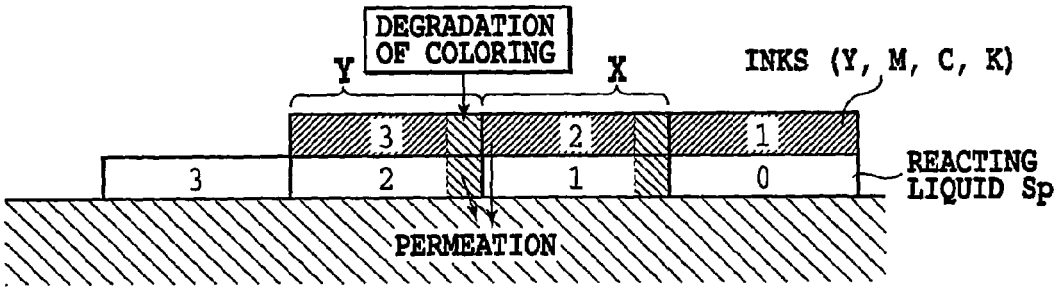
FIG. 3B is a diagram showing a nature of the problem to be resolved with respect to the arrangement of the heads shown in FIG. 3A.

The above-mentioned effect of the present embodiment will further be described in detail. In the following description, for the convenience of the description, a scanning area for the first scan with the reacting liquid is defined as an area X, while a scanning area for the second scan with the reacting liquid is defined as an area Y, and the description will be made as to the area Y. The major portion of the reacting liquid to be applied to the area Y during the second scanning comes into contact for reaction with the ink to be applied during the third scanning coming one scanning cycle later. However, the reacting liquid present in the vicinity of the boundary for the area X and the same present within the area Y also comes into contact with the ink applied to the area X during the second scanning prior to application of the ink made during the third scanning. For instance, in the conventional process as is described previously referring to FIGS. 3A and 3B, the process for reducing the amount of the ink to be applied within the vicinity of the boundary (i.e., the area C) with the area Y within the area X is not provided, so that the amount of the ink applied within the area C during the second scanning becomes relatively large, thereby causing relatively large amount of the reacting liquid present in the vicinity of the boundary within the area Y comes into contact with the ink to be applied during the second scanning. In contrast, in the case of the present embodiment, the ink to be applied is divided into two portions so that the divided portions of the ink can be ejected separately within the vicinity of the boundary (i.e., the area C) with the area Y, which is within the area X, during the two separate scans (i.e., the second scan and the third scan), so that the amount of the ink to be applied within the area C during the second scanning can be reduced thereby reducing the amount of the reacting liquid coming into contact with the ink in the vicinity of the boundary with the area Y. In this way, it can be prevented that the amount of reacting liquid remaining near the surface of the printing medium (i.e., the amount of the reacting liquid capable of reacting with the ink to be applied during the third scanning) becomes excessively small relative to the amount thereof within the non-boundary portion within the area Y. In consequence, the degree of the non-uniformity of the color resulting from the difference in the optical density between the boundary portion and the non-boundary portion can be reduced. Further, needless to say, the mask applicable to the area C is not limited to the previously described one. Basically, within the area C, the ink is ejected by being separated into two portions to reduce the amount of the ink coming into contact with the reacting liquid during each scan can be reduced. Thus, the pattern of the mask does not matter except the case where the amount of the ejected ink coming into contact with the reacting liquid hardly differs from the amount of the ink ejected within the area C during the single scan. For instance, the pattern of the mask may be one designed for the uniform duty such as 50% duty within the area C for both the first scan and the second scan. Further, in the pattern wherein the duty increases gradually, the duty may be set to 0% with respect to the several rasters adjacent to the boundary with the reacting liquid. However, it is desired for the mask to be designed so as to prevent any nonuniformity of the color from developing newly within the area C and the boundary thereof, since, within the area C, the ink ejected during the first scan is deposited adjacent to the reacting liquid to be ejected during the same first scan; the ink ejected during the second scan is deposited adjacent to the reacting liquid, which has been ejected during the scan made preceding to the immediately preceding scan; and, in the outside of the area C, the ink is ejected over the reacting liquid which has been ejected during the preceding scan.

The printing process based on the system as discussed above is designed so that, as illustrated in FIG. 5B and FIG.

5C, for the beginning portion of an image to be printed, during the $0^{th}$ scan as being the forward scan, the reacting liquid Sp is ejected from the row of the reacting liquid ejection orifices having the length, (n−a). During this scan, the ink is not ejected.

Then, after the printing sheet is transferred as much as the amount A, the first scan as being the backward scan is made. During this first scan, not only the area A is scanned with the row of the reacting liquid ejection orifices having the length of (n−a) to eject the reacting liquid Sp but also the area B is scanned with the row of the ink ejection orifices having the length of n to eject the ink. However, those ejection orifices outside the margin of the image will not eject the ink. Further, the group of the ejection orifices confronting the area C eject the ink according to ejection data for 50% duty during the first scan as described previously.

Similarly, subsequent to feeding of the printing sheet by the amount A, the row of the reacting liquid ejection orifices, having the length of (n−a), scans the area having the width A to eject the reacting liquid Sp thereto, while the row of the ink ejection orifices, having the length of n, scans the area having the width B to eject the ink thereto. In these processes, out of the ink ejection orifices, a first group of the ink ejection orifices that corresponds to the area having the width C for which printing of 50% duty is performed during the first scan, and a second group of the ink ejection orifices that is located at opposite side to the first group and corresponds to the area having the width C which is adjacent to the scanning area of the reacting liquid, eject the ink based on data of 50% duty. By repeating these processes a predetermined amount of printing such as that equivalent to the amount of the printing for 1 page can be performed.

Further, in the above-mentioned embodiment, the pitch of the ink ejection orifices arranged in a row is assumed to be equal to that of the reacting liquid ejection orifices arranged in a row, but the pitch for the former may differ from that of the latter and vice versa. Similarly to the case of the above-mentioned embodiment, the amount of feeding the printing sheet may be set equal to the width of the area to be scanned with the reacting liquid (i.e., the amount equivalent to the number of the ejection orifices×the arrangement pitch P where the diameter of the reacting liquid dot is assumed to be equivalent to the pitch of the row of the ejection orifices). Thus, in such a case, the C is (width of the area of the scan with the ink)−(the width of the area of the scan with the reacting liquid).

Further, in the case of the above-mentioned embodiment, the thinning process is used as a means for reducing the amount of the ink to be consumed per unit area within the area C, but the thinning process is not the only process applicable in this embodiment. Besides such method characterized by reducing the density of the ink dots, the method characterized by reducing the diameter of the ink dots is also applicable. However, in the case of the image including a highlighted portion wherein the density of the dots is primarily low, it is hard to gradually vary the density of the dots even if such method is employed. Thus, in such a case, it is desirable to gradually vary the diameter of the dot. More specifically, for example, in the case of the system wherein the ink is ejected by utilizing thermal energy generated by the electro-thermal conversion element employed in the above-mentioned embodiment, the ejection rate is varied by employing the known process such as one characterized by varying the pulse amplitude or the like to be applied to the electro-thermal conversion element to thereby vary the diameter of the dot.

Further, in the above-mentioned embodiment, a liquid having low permeability is used as the reacting liquid so that even if there is the time lag equivalent to the time for 1 pass before the ink and the reacting liquid come into contact with each other, sufficient amount of the reacting liquid can be kept remain on the surface of the printing medium to allow the ink to react therewith sufficiently. Further, it is preferred for the ink to contain the pigment. Using the pigment ink facilitates the coagulation of the pigment when in contact with the reacting liquid thereby not only preventing (the ink) from permeating into the printing medium but also facilitating the settlement thereof on the surface. In this way, the coloring of the image can be facilitated.

The present invention is applicable to the printing head designed for utilizing thermal energy as is used in the above-mentioned embodiment as well as to the printing head designed for ejecting the ink utilizing the deformation of a piezoelectric element.

Reacting Liquid

Next, the description will be made as to the reacting liquids applicable to the present embodiment. In the case of the present embodiment, the desirable reactants to the pigment contained in the ink are the polyvalent metal salts. The polyvalent metal salt is composed of the polyvalent metal ion, higher than divalent metallic ion and the negative ions bonding with such polyvalent metal ions. As the examples of the polyvalent metal ions, the divalent metallic ions such as the Ca2+, Cu2+, Ni2+, Mg2+ and Zn2+, and the trivalent metallic ions such as the Fe3+and A13+ can be enumerated. Further, the Cl−, NO3−, SO4− and the like can be enumerated as the negative ions. In order to form a coagulant film through the instantaneous reaction, the total charge concentration of the polyvalent metal ion in the reacting liquid needs to be more than 2 times the total charge concentration of the reversed polarity ion in the pigment ink.

As the water soluble organic solvents there are, for example, the amid and analogs such as the dimethylformamide and the dimethylacetamide; the ketone and the analogs such as the acetone; the ether and analogs such as the tetrahydrofuran and dioxiane; the polyalkylene glycol and analogs such as the polyethylene glycol and polypropylene glycol; the alkylene glycol and the analogs such as the ethylene glycol, propylene glycol, butylenes glycol, triethylene glycol, 1,2,6-hexane triose, thioglycol, hexylene glycol, diethylene glycol; the lower alkyl ether of the plolyalcohol and analogs such as the ethylene glycol methyl ether, diethylene glycol monomethyl ether, triethylene glycol monoethylene ether; the monovalent alcohol and the anlogs such as the ethanol, isopropyl alcohol, n-butyl alcohol and isobutyl alcohol; glycerin, N-methyl-2-pyrrolidone,1,3-dimethyl-imidazoli zinon, triethanolamine, sulfolane, dimethyl sulfoxide. Though there is no specific limitation as to the content of the above-mentioned water soluble organic solvent in the reacting liquid, it is desired for the content to be within 5 to 60 weigh %, preferably within 5 to 40%.

Further, when necessary, the reacting liquid may be properly mixed with the additives such as the viscosity modifier, pH modifier, preservatives, antioxidant or the like, but the amount and the kind of the surface active agent to serve as the permeation accelerator are selected in consideration of the requirements given later. Besides, the reacting liquid is preferred to be colorless, but using the light-colored reacting liquid is permissible as long as the color is light enough for not affecting the color tone of each ink when mixed therewith. Further, among the various preferable physical properties of the above-mentioned reacting liquid, the viscosity is preferable to be adjusted within the area of 1 to 30 cps.

Ink

Next, the description will be made as to pigment inks usable for the present embodiment. The content of the pigment in the pigment ink is 1 to 20 weight % to the total weight of the ink, preferably within 2 to 12 weight %. For example, from among the usable pigments, the carbon black can be enumerated specifically as a black pigment. The carbon black is preferred to be manufactured, for example, by the furnace process or the channel process; among other preferred physical properties of such carbon black there are the diameter being within 15 to 40 mμ(nm), the specific surface area to be measured by the BET method being within 50 to 300 $m^2/g$, the oil absorption to be measured by DBP being 40 to 150 ml/100 g, the volatile matter being within 0.5 to 10%, and the pH value being within 2 to 9. Among the commercially available carbon blacks having such physical properties, there are, for example, No. 2300, No.900, MCF88, No.33, No.40, No.45, No.52, MA7, MA8, No.2200B (the products of Mitsubishi Kasei); RAVEN1255 (the product of Columia); REGAL400R, REGAL330R, REGAL660R, MOGUL L (the products of Cabot); Color Black FW1, Color Black FW18, Color Black FW1, Color Black S170, Color Black S150, Printex 35, Printex U (the products of Degssa), all of which are good enough for the purpose of the present invention.

Those preferable yellow pigments include, for example, C.I. Pigment Yellow 1, C.I. Pigment Yellow 2, C.I. Pigment Yellow 3, C.I. Pigment Yellow 13, C.I. Pigment Yellow 16, C.I. Pigment Yellow 16, C.I. Pigment Yellow 83; those preferable magenta pigments include, for example, the C.I. Pigment Red 5, C.I. Pigment Red 7, C.I. Pigment Red 12, C.I. Pigment Red 48 (Ca), C.I. Pigment Red 48 (Mn), C.I. Pigment Red57 (Ca), C.I. Pigment Red 112, C.I. Pigment Red122; those preferable cyanic pigments include, for example, the C.I. Pigment Blue 1, C.I. Pigment Blue 2, C.I. Pigment Blue 3, C.I. Pigment Blue 15, C.I. Pigment Blue 16, C.I. Pigment Blue 22, C.I. Pigment Blue 4, C.I. Pigment Blue 22, C.I. Pigment Blue 4, C.I. Pigment Blue 6. However, those pigments other than those mentioned above are also applicable to the present invention. Further, besides those pigments mentioned above, the pigments such as the auto dispersion type pigments are also applicable to the present invention.

Further, as the dispersing agent any water soluble resin will do; however, one whose weight average molecular weight is within 1,000 to 30,000 is preferable, and one within 3,000 to 15,000 is more preferable. As such dispersing agents, for example, there can be enumerated the block copolymer consisting of at least 2 monomers (at least one being a water soluble polymeric monomer) chosen from among the styrene, the derivative of styrene, vinyl naphthalene, the derivative of the vinyl naphthalene, the fatty alcohol ester of α, β-ehthylene unsaturated carboxylic acid, acrylic acid, the derivative of the acrylic acid, maleic acid, the derivative of the maleic acid, itaconic acid, the derivative of the itaconic acid, fumaric acid, the derivative of the fumaric acid, vinyl acetate, vinyl pirrolidone, acrylic amide, the derivative of the acrylic amide, or random copolymer, graft copolymer or the salts of such copolymers. Besides, the natural resins such as rosin, shellac, starch or the like may be used. These resins are the alkali-soluble resins and soluble in aqueous solution the alkali and are soluble in the aqueous solution of the base. Further, the water soluble resins used as the dispersing agent for the pigment are preferred to be contained in the coloring pigment ink within the area of 0.1 to 5 weight %.

Especially, in the case of the pigment ink containing the pigment such as one discussed above, the chemical property of the pigment ink is preferable to be kept neutral state or alkaline state. By meeting such requirements, the solubility of the water soluble resin to be used as the dispersing agent for the pigment can be enhanced thereby prolonging the life of the pigment ink. However, such pigment ink can cause the corrosion of the various parts of the ink jet printing apparatus, so that the pH value of such pigment ink is preferred to be set within 7 to 10 pH. As the pH modifier to be sued for such purpose, there are, for example, various organic amines such as the diethanolamine and the triethanolamine, the inorganic alkali agents, as being the hydroxides of the alkali metals, such as the sodium hyrooxide, lithium hydroxide, potassium hydroxide, the organic acids and the mineral acids. The pigments and the dispersing agents, as being the mixture of the water and the soluble resins such as those discussed above, can be dispersed or dissolved in the water medium. For the pigment ink, the preferable water medium is the mixture of the water and the water soluble organic solvent; for such solvent, however, the water preferable to be used is not ordinary water containing various ions but the ion exchange water (deionized water).

As the water soluble organic solvents to be mixed with the water when being used, there are the 1-4 carbon alkyl alcohols such as the methyl alcohol, ethyl alcohol, n-propyl alcohl, isopropyl alcohol, n-butyl alcohol, sec-butyl alcohol, tert-butyl alcohol; the amides such as the dimethyl formamide, dimethyl acetamide; the ketone or keto-alcohols such as the acetone, diacetone alcohol; the ethers such as the tetrahydrofuran and dioxane; the polyalkylene glycols such as the polyethylene glycol, polypropylene glycol; the alkylene glycols (with alkylene base having 2-6 carbon atoms) such as the ethylene glycol, propylene glycol, butylene glycol, triethylene glycol, 1,2,6-hexanetriol, thiodiglycol, hexylene glycol, diethylene glycol; glycerin; the low alkyl ethers of polyalcohols such as the ethylene glycol monomethyl (or ethyl), ether, triethylene, glycol monomethyl (or ethyl); N-methyl-2-pirrolidone, 2-pirrolidone, 1,3-dimethyl-2-imidazolidinon. Among these many water soluble organic solvents, the polyalcohol such as the diethylene glycol and the low alkyl ether of the polyalcohol such as the triethylene glycol monomethyl (or ethyl) are preferable to be used.

In general, the content of any water soluble organic solvent in the ink among those discussed above is within 3 to 50 weight % of the total weight of the coloring pigment ink, more preferably within 3 to 40 weight %. Further, the content of the water to be used (in the ink) is within 10 to 90 weight % of the coloring pigment ink, more preferably within 30 to 80 weight %.

Further, in order to obtain the pigment ink having the desired physical properties in addition to the above-mentioned contents, the surface active agent, defoaming agent, preservative or the like may be added properly. Especially, the surface active agent functions for speeding the permeation of the liquid contents of the reacting liquid and the coloring pigment ink into the printing medium, and the amount such surface active agent needs to be considered in defining the permeability of the ink as discussed later. For example, the amount (of the surface active agent) to be added (to the ink) is within 0.05 to 10 weight %, more preferably within 0.5 to 5 weight %. As the anionic surface active agents, those used commonly such as the carboxylate salt type, sulfuric ester type, sulfonate type, phosphate ester type are preferable to be used.

In preparing the pigment ink containing the above-mentioned pigments, the processes to be undergone sequentially comprises the first process for adding the necessary pigment to the water and the aqueous medium, which at least containing the water, the mixing and stirring process, the dispersion process by using the dispersion machine to obtain desired dispersed liquid wherein the pigment has been dispersed as desired and:the process for the centrifugal separation to be employed when necessary to obtain the desired dispersed liquid. Then, the liquid containing the dispersed pigment undergoes the process for adding the sizing agent and the properly selected additives, which have been selected from among the above-mentioned additives, and then proceeds to the stirring process to be finished as the desired pigment ink.

Further, when using the alkali soluble resin, as is mentioned above, is to be used as a dispersing agent, the base need to be added; the base to be added is preferable to be chosen from the organic amines such as monoethanol amine, diethanol amine, triethanol amine, amine methylpropanol, ammonia, or the inorganic bases such as the potassium hydroxide, sodium hydroxide.

Further, in preparing the coloring pigment ink containing the pigment, it is effective to undergo the premixing process lasting at least 30 minutes prior to the dispersion process including the stirring of the aqueous medium containing the pigment. More specifically, such premixing operation is preferable to be applied for speeding the adsorption of the dispersing agent to the surface of the pigment by enhancing the wettability of the surface of the pigment.

The dispersion apparatus to be used for the dispersion process of the pigment, may be any dispersion apparatus that is generally applicable to the dispersion process of the pigment such as the ball mill, roll mill, sand mill or the like. Among such dispersion apparatuses, the high-speeds and mill is preferable for the use. Among such types of the high-speed dispersion apparatuses, there are, for example, the super mill, sand grinder, beads mill, agitator mill, grain mill, (dinomill), bar mill and (kobo mill) (All are the brand names).

In the jet ink printing system using the ink containing the pigment, in order to prevent the clogging of the ink ejection orifices, it is necessary to use the pigment having an optimum particle size distribution; in order to obtain the pigment having the desired particle size distribution, it is necessary to meet the requirements, that is, using the crushing medium of smaller size in using the dispersing apparatus, increasing the filling amount of the crushing medium, increasing the processing time, decreasing the ejecting rate, separating the crushed pigment by size after the crushing operation and the combination thereof.

Further, in the case of the present embodiment, the relationship between the absorption coefficient Kas of the reacting liquid to the printing medium and the absorption coefficient Kai of the ink to the printing medium is desirable to be within the area given below.

$$Kas<1.5\times Kai,$$

and more preferably to be $$Kas<2.0\times Kai.$$

In this way, the reacting liquid and the ink are made to permeate quickly into the printing medium.

SPECIFIC EXAMPLES

The specific examples of the present invention will be described specifically referring to the comparable examples. For reference, in the following description, the term, parts and % are on the basis of weight unless otherwise specified.

First, the pigment inks, black, cyanogens, magenta and yellow in color, each containing the pigment and the anionic compounds, are obtained according to the processes described in the following. The preparation process for the black ink will be described in the following.

Pigment Ink

[Preparation of Pigment Dispersing Agent (Liquid)]

| | |
|---|---|
| Copolymer of Styrene, Acrylic acid, Acrylic acid ethyl (Acid value: 240, Weight average molecular weight: 5,000) | 1.5 part |
| Monoethanol Amine | 1.0 part |
| Diethylene Glycol | 5.0 parts |
| Ion-exchange Water | 81.5 parts |

The above contents are mixed and heated on a water bath set to 70° C. to let the resin contents dissolve completely. The 10 parts of the carbon black (MCF88, a new product manufactured on trial basis by Mitsubishi Kasei) and 1 parts of the isopropyl alcohol are added to the solution, and the mixture is made to undergo the pre-mixing process lasting for 30 minutes; then, the mixture is made to undergo the following dispersion processes.

Processing by dispersing apparatus: Processing by sand grinder (Product of Igarashi Kikai)

Processing by dispersing medium: Processing by zirconium beads of 1 mm in diameter Processing by filling with crushing medium: Filling ratio of 50% (Volume ratio)

Crushing process: 3 hours

Further, (the mixture) is made to undergo the processing by the centrifugal separator (to be operated at 12,000 rpm for 20 minutes) to obtain the desired liquid containing the dispersed pigment by removing the non-uniform particles.

[Preparation of Black Pigment Ink K]

The black ink, using the above-mentioned dispersing liquid and containing the pigment, is prepared by mixing the following contents. The surface tension of (the prepared ink) was 34 mN/m.

| | |
|---|---|
| Dispersing agent for the pigment: | 30.0 parts |
| Glycerin | 10.0 parts |
| Ethylene glycol | 5.0 parts |
| N-methyl pirrolidone | 5.0 parts |
| Ethyl alcohol | 2.0 parts |
| Acetylenol EH (Product of Kawaken Fine Chemial) | 1.0 part |
| Ion-exchange water | 47.0 parts |

Reacting Liquid

Next, the description will be made as to the reacting liquid. The constituents, set forth below, are mixed, dissolved and filtered under pressure with a membrane filter having the pore size of 0.22 μm (Product Name: Fuoropore Filter by Sumitomo Denko) to obtain a reacting liquid whose pH value is adjusted to 3.8.

[Composition of Reacting Liquid]

| | |
|---|---|
| Diethylene glycol | 10.0 parts |
| Methyl alcohol | 5.0 parts |
| Magnesium nitrate | 3.0 parts |
| Acetylenol EH (Product of Kawaken Fine Chemical) | 0.1 part |
| Ion-exchange water | 81.9 parts |

The pigment ink K and the reacting liquid, prepared by the foregoing processes, are used with the printing head, illustrated in FIG. 5A and designed for enabling the 1-pass and bidirectional printing process, illustrated in FIG. 5B, and the solid image was obtained. Further, the printing head according to the present embodiment is provided with the ejection orifices having the ejection orifice density of 1200 dpi; more particularly, the printing head is provided with 200 reacting liquid orifices and 256 (n=256) ink ejecting orifices. There are provided 56 ink ejection orifices in total, which are arranged in two rows (28 orifices in each row: a=28) matching to area C wherein the pigment ink is ejected by being separated into two portions for being ejected respectively during the 2 scans by the printing head. Further, for the overlapped portion (the area C) of the scanning areas to be scanned with the pigment ink ejection orifice rows, the masks of the same pattern are used for both the first scan and the second scan. More specifically, the 28 rasters matching to the area C are divided into 9 approximately equal portions so that the mask pattern that not only enables the printing duty to increase gradually for 10%, 20%, up to 90% with respect to the 4 rasters, 3 rasters up to the last 3 rasters sequentially from the side of the boundary with the scanning area of the reacting liquid ejection orifice row but also enables the thinning ratio for the whole overlapped portion to become 50%. In such a system, the above-mentioned printing duty is assumed to be 100% where 1200×1200 dots per square inch are formed. The dive frequency for each printing head is set to 15 KHz, while an ejection rate of each printing head for the ink and the reacting liquid is set to about 4 pl per drop. The environmental conditions for the printing test is fixed to 25° C./55% RH. The image obtained as the result of printing operation according to the present embodiment was free of any conspicuous defect such as the white streaks thereby proving that the quality of obtained image is satisfactory.

Second Embodiment

A second embodiment of the present invention is directed to a configuration that scanning for the reacting liquid is performed two times in the vicinity of the boundary between scanning areas. More specifically, according to the present embodiment, the scanning is applied 2 times to a predetermined joint portion (boundary portion) in the vicinity of a boundary for the adjacent scanning area to be scanned with both the ink ejection orifice row and the reacting liquid ejection orifice row, while the scanning area other than the above-mentioned joint portion is scanned only once for ejection of the ink and ejection of the reacting liquid. The system for carrying out the present embodiment is similar to that of the first embodiment except the system relating to that number of times of scanning, and thus the rest of the description of the present embodiment will be omitted here. Thus, mainly those points differing from the first embodiment will be described in the following.

FIG. 8A is a diagram schematically showing the arrangement of printing heads for ink and a reacting liquid according to the present embodiment; the rows of the ejection orifices for the respective colors of ink and the reacting liquid are represented by the straight lines as shown FIG. 5A. FIG. 8B is a schematic diagram showing the partial section of a so-called solid image, formed by the scan of the printing heads shown in FIG. 8A, viewed along a direction of scanning. Further, FIG. 8C shows a way by which the ink and the reacting liquid are applied during each scan, in terms of the positional relationship between the ejection orifice rows and a printing sheet. Further, according to the present embodiment, each printing head takes the chip form, and the chip-form heads are used in a unitized form; however, the application of the present invention is not limited to such a mode but the printing heads may be designed for being operated independently from one another; besides, regardless of the mode of the application, the printing heads may be identified by the row of the ejection orifices in describing the function of such ejection orifice as is obvious from the following description.

In FIG. 8B, each of the trapezoidal areas, shown as areas at lower side, represents an area scanned with the row of the reacting liquid ejection orifices. More specifically, in the figure, each of the trapezoidal areas denoted by the numeral N (N being any integer equal to or larger than 0) represents the area scanned by the reacting liquid orifice row during the Nth scan, that is, the area to which the reacting liquid is applied during the Nth scan. In other words, the trapezoidal area represented by the numeral 1 represents the area scanned with the reacting liquid orifice row during the first scan, that is, the area to which the reacting liquid is applied during the first scan. On the other hand, each upper side trapezoidal area is to be scanned with the row of the ink ejection orifices. More specifically, each of the trapezoidal areas denoted by the numeral N (N being any integer equal to or larger than 0) corresponds to the area scanned with the row of the ink ejection orifices during the Nth scan or the area to which the ink is applied during the Nth scan. Further specifically, the trapezoidal area denoted by the numeral 1 corresponds to the area scanned with the row of the ink ejection orifices during the first scan, that is, an area to which the ink is applied during the first scan.

As shown in FIG. 8A, with respect to each of the inks represented by C, M and Y, similarly to the case of the first embodiment, the ejection orifices are arranged in the opposite two rows (i.e., being arranged symmetrically) with respect to an axis perpendicular to the scanning direction, while the row of the ink ejection orifices for the ink K is arranged at a center of the symmetrically arranged rows of the ink ejection orifices. Further, the above-mentioned symmetrical arrangement is not necessarily limited to the case where the row of the orifices of the ink K is arranged at the center between the symmetrically arranged set of two rows of the ejection orifices but may be replaced with any of the rows of the ejection orifices for the inks, C, M and Y. In such a case, the row of the ejection orifices for the ink K may be arranged symmetrically to the row of the ejection orifices of any of the inks, C, M and Y. Further, the ink ejection orifice to be arranged centrally among the rows of the ink ejection orifices need not necessarily be a single row but may be any adjacent-two rows. In the present embodiment, each row of the ink ejection orifices comprises n pieces of ejection orifices.

On the other hand, the row of the ejection orifices ejecting a reacting liquid Sp is arranged adjacent to one of the rows of ink ejection orifice of the ink C along the sub-scanning direction. Further, in the present embodiment, the pitch p of the ink ejection orifices arranged in row and the pitch p of the reacting liquid orifices arranged in row are equalized for all the rows of the ejection orifices for the ink and the row of the orifices of the reacting liquid.

For all the rows of the ejection orifices, the width of scanning area is commonly set to E as shown in FIG. 8B. On the other hand, the width of the area in the vicinity of the boundary in the scanning area by the row of ink ejection orifices of respective colors, that is, the width of the joint portion in the scanning area by the respective inks, which is covered by two scans for the formation of the image, is F1. While, the width of the area in the vicinity of the boundary in the scanning area by the row of reacting liquid ejection orifices, that is, the width of the joint area, which is covered by two scans for the formation of the image, is F2. However, the widths of these scanning areas (to be covered 2 times for the formation of the image) are equal, that is, F1=F2. For the convenience of description, it is given that F1=F2=F. This width F, as described hereunder, can be determined by setting the length of the row of the ink ejection orifices, length of the row of the reacting liquid ejection orifices and the amount of the feeding of the paper sheet. Further, the width of this scanning area is dependent on the size of the dot to be formed with the ink or the reacting liquid ejected onto the printing medium as in the case of the first embodiment; however, in general, the such size of the dot is set to a size that is large enough for keeping the dots of the ink or the dots of the reacting liquid at least in contact with one another without leaving any gaps; for instance, in the case of the present embodiment, the diameter of each dot is assumed to correspond to the pitch P, and, on this assumption, E and F are set respectively as $E=n\times p$ and $F=a\times p$.

The amount of feeding the printing sheet for each scan (i.e., the amount of feeding the printing medium between two successive scans) is set smaller by the width of the scanning area F covered by 2 scans than the width of the area scanned with the row of the ejection orifices of the reacting liquid or the ink, that is, such width is set to the relationship, i.e., $G=E-F=(n-a)\times p$. In this way, it can be made possible that the area whose width is F1 is scanned 2 times with the row of the ink ejection orifices, while the area whose width is F2 is scanned 2 times with the row of the reacting liquid ejection orifices. Thus, in the case of the present embodiment, the thinning processing (i.e., the mask processing)-according to the ink ejection data is applied to the area having the width F1, while the thinning processing (i.e., the mask processing) according to the reacting liquid ejection data is applied to the area having the width of F2 so that the formation of the image can be completed by 2 scans. In this way, the amount of the ink and the amount of the reacting liquid ejected within the areas having the width of F1 and the width of F2 respectively during the single scan can be reduced respectively by setting the printability duty during the single scan to, for example, 50%. In other words, in the case of the present embodiment, for both the area to be scanned with the row of ink ejection orifices for each color and the row of the reacting liquid ejection orifices, the predetermined joint areas (F1 and F2) in the vicinity of the boundary of the scanning area are scanned 2 times respectively for the formation of the image. In this way, when the ink of any one color and the reacting liquid are to be applied on the areas separated by the boundary of the scanning areas during the same scan, the amount of such ink and the amount of such reacting liquid coming into contact with each other over such boundary can further be reduced respectively compared with the case of the first embodiment. In consequence, the non-uniformity of the color between different scanned areas or between different boundaries resulting from a difference in the permeability between the ink and the reacting liquid can be reduced further.

Figure 9:
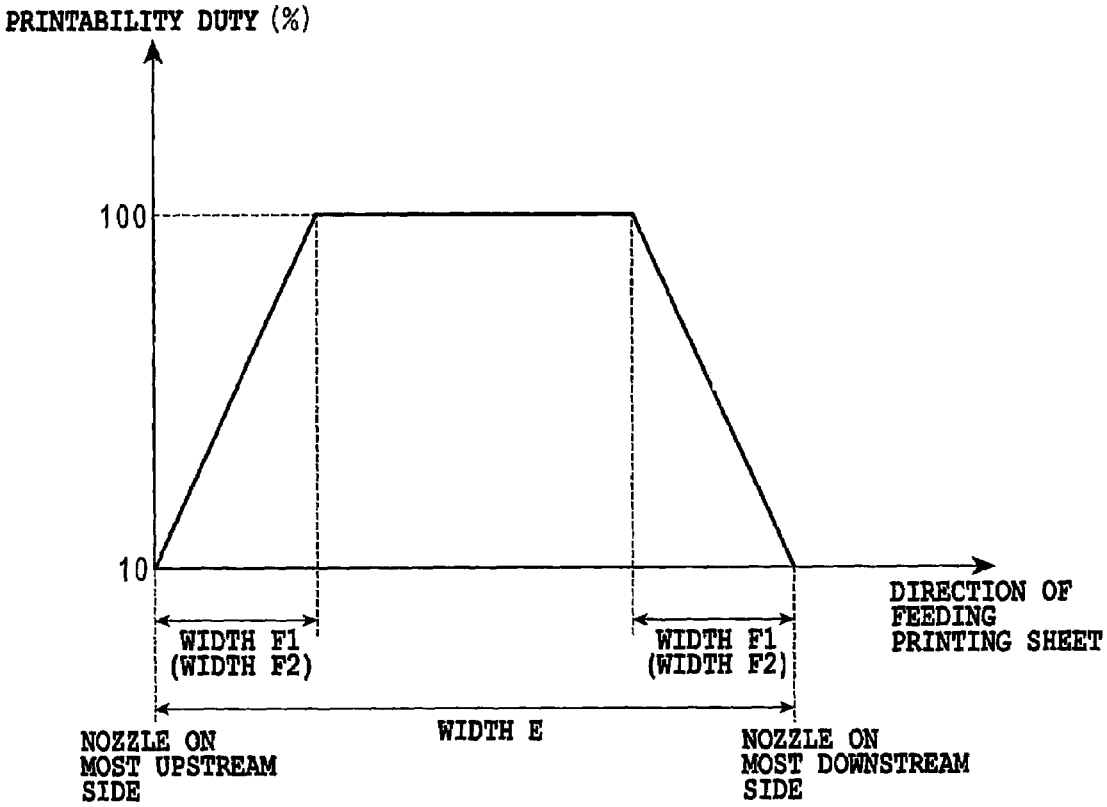
FIG. 9 is a diagram illustrating a mask to be used in the second embodiment of the present invention.

In the present embodiment, on the basis of the area having the width F1 (relating to a-pieces of scanning lines or the raster data), the mask corresponding to the first scan is divided into 9 equal parts or 9 approximately equal parts so that the printability duty can be increased gradually in the order of 10%, 20% through 90% throughout the area having the width F1 starting from the boundary to the reacting liquid, while the mask corresponding to the second scan is used as the pattern for complementing the formation of the dot on the contrary to the above-mentioned pattern. On the other hand, on the basis of the area having the width F2 (relating to the data for a-pieces of scanning lines or the raster data), the mask corresponding to the first scan is divided into 9 equal parts or 9 approximately equal parts so that the printing duty can be increased gradually in the order of 10%, 20% through 90% throughout the area having the width F2 starting from the orifice on the most upstream side in the direction of the feeding of the paper sheet (see FIG. 9), while the mask corresponding to the second scan is used as the pattern for complementing the formation of the dot on the contrary to the above-mentioned pattern. This mask pattern, when set to correspond to the row of the ink ejection orifices (or the row of reacting liquid ejection orifices), the mask for the first scan corresponds to the outermost row of the ejection orifices corresponding to the width F1 (or F2) on the upstream side of the direction of the feeding of the printing sheet, while the mask for the second scan corresponds to the mask, that is, the mask for the first scan reversed (in direction) from the side of the outermost row of the ejection orifices. Further, when viewed on a different basis, the mask applied to the scanning with the row of the ink ejection orifices and the mask applied to the scanning with the row of the reacting liquid orifices take the trapezoidal form respectively as shown in FIG. 9. In other words, during the first scan, all the rows of the ink ejection orifices and the reacting liquid ejection orifices correspond to the width E, while, out of the rows of the ink (or the reacting liquid) ejection orifices, the predetermined number of orifices on both the upstream side and the downstream side correspond to the width F (or F2). Then, the printability duty of the predetermined number of orifices corresponding to the width F1 (or F2) is set to 10% to 90% so that the width F1 (or F2) for printing can be divided into 2 cans. On the other hand, the printing duty of the orifices corresponding to the areas other than the area having the width of F1 (or F2) is 100%, so that the printing corresponding to the areas other than the area having the width of F1 (or F2) can be made during the single scan.

The effect of the present embodiment will be described in further detail. Here, for the convenience of the description, as shown in FIG. 8B, the scanning area with the ink by the second scan is defined as the area X, while the scanning area with the reacting liquid by the second scan is defined as the area Y, and the effect of the present embodiment will be described on the bases of the scanning area Y. The most of the reacting liquid to be applied within the area Y during the second scan comes into contact for reaction with the ink to be applied during the third scan one scanning cycle later. However, the reacting liquid present in the area Y, more specifically in the vicinity of the boundary (i.e., within the area having the width F2) to the area X, also comes into contact with the ink applied in the area X during the second scan prior to application of the ink to be made during the third scan. For instance, in the case of the conventional process described in FIGS. 3A and 3B, within the area X, the area (i.e., the area having the width F1) in the vicinity of the boundary to the area Y is not subject to the processing for reducing the amount of the ink to be applied during the second scan, so that the relatively large amount of the reacting liquid present within the area Y, more specifically in the area in the vicinity of the boundary, is apt to come into contact with the ink applied during the second scan. On the other hand, in the present embodiment, within the area X, the ejection of the ink to the area in the vicinity (i.e., the area having the width F1) of the boundary to the area Y is divided into two portions for 2 scans (i.e., the second scan and the third scan), while within the area Y, the ejection of the reacting liquid is divided for 2 cans (the first scan and the second scan) in the vicinity of the boundary (i.e., area having the width F2) to the adjacent area X, thereby reducing the amount of the ink applied onto the area having the width F1 during the second scan as well as reducing the amount of the reacting liquid applied onto the area having the width F2 during the second scan; in consequence, within the area Y, the amount of the reacting liquid present in the vicinity of the boundary thereof coming into contact with the ink applied during second scan can be reduced. As a result, it can be prevented that, during the third scan for applying the ink, the amount of the reacting liquid remaining near the surface of the printing medium (i.e., the amount of the active reacting liquid capable of reacting with the ink applied during the third scan) in the vicinity of the boundary decreases excessively compared with the amount of the reacting liquid present in the non-boundary portion within the area Y. In consequence, the non-uniformity of the color resulting from the difference in the optical density between non-boundary portion and the boundary portion can be reduced. Further, the mask applied to the area having the width F1 (or F2) is, needless to say, not limited to the above-mentioned example. Basically, within the areas having the width F1 and the width F2 respectively, the ejection of the ink and the ejection of the reacting liquid are respectively divided into two portions for the ejection to be made 2 times respectively, whereby the amount of the ink and the amount of the reacting liquid, which are ejected during the same scan, coming into contact with each other at a time can be reduced. Because of this fact, any mask pattern may be applied except the case where the amount the ink and the amount of the reacting liquid coming into contact with each other vary hardly from the case where the ink is ejected during the single scan within the area having the width G. For example, the pattern (for printing) within the areas having the width of F1 and the width F2 respectively may be set to the 50% printing duty for the first scan and the second scan respectively. Further, in the case of the pattern for the process where the printability duty is set to increase gradually, the printability duty may be set to 0% with respect to the several rasters adjacent to the boundary with the reacting liquid (or the ink). However, it is preferable to use the mask not causing any additional non-uniformity of the color in the boundary between the scanning area of the reacting liquid and the scanning area of the ink.

With respect to the printing operation according to the present embodiment, as shown in FIG. 8C, after ejecting the reacting liquid during the 0th scan (forward scan), the printing sheet is fed by the amount G (G=E−F), and then the first scan as being the backward scan takes place. With this first scan, the row of the reacting liquid orifices having the length n scans the area having the width E to eject the reacting liquid Sp, while the row of the ink ejection orifices having the length n scans the area G having the same width as the width E to eject the ink. However, the orifices being outside the margin of the image will not eject the ink. Further, within the boundary portion between the scanning area of the reacting liquid and the scanning area of the ink, the ejection of the ink and the ejection of the reacting liquid are made respectively according to ejection data set for 50% printability duty.

Then, after feeding the printing sheet by the amount G, during the second scan as being the forward scan, the row of reacting liquid ejection orifices having the length n scans the area having the width E to eject the reacting liquid Sp, while the row of the ink ejection orifices scans the adjacent area having the width E to eject the ink. In this process, among the row of the ink ejection orifices, the group of the ejection orifices corresponding to the area having the width F1, wherein the printing at 50% printability duty is made during the above-mentioned first scan, and the group of the ejection orifices corresponding to area having the width F2, adjacent to the scanning area of the reacting liquid to be ejected on the opposite side of the previously mentioned group of the ejection orifices during the same scan, makes ejection according to the ejection data for the 50% printability duty. Similarly, among the row of the reacting liquid ejection orifices, the group of ejection orifices, corresponding to the area having the width F2 and used for the printing at 50% printability duty during the above-mentioned first scan and the group of the ejection orifices, corresponding to the area having the width F1 and adjacent to the scanning area for the ink wherein ejection is made on the opposite side of the previously mentioned group of the ejection orifices, make ejection according to the 50% duty ejection data. By repeating the foregoing printing operations the predetermined amount of printing such as that for 1 page can be made.

Further, in the above-mentioned embodiments, the pitch of the ejection orifices of the ink arranged in row and the pitch of the ejection orifices of the reacting liquid in row are equalized for each other, but such pitch of the ejection orifices may differ between the ink and the reacting liquid. In such a case, similarly to the case of the above-mentioned embodiment, the amount of the feeding of the paper sheet may be set equal to the width of the scanning area with the reacting liquid (i.e., number of ejection orifices x arrangement pitch p where the diameter of each dot of the reacting liquid is assumed to correspond to the pitch of the arrangement of the reacting liquid ejection orifices).

Other Embodiments

In all the foregoing embodiments, it is assumed that each of the coloring inks has a higher permeability than that of the reacting liquid and that the ink is applied over the reacting liquid; however, such relationship between the ink and the reacting liquid may be reversed. In other words, the reacting liquid having a relatively higher permeability than that of the ink may be applied over the ink. In such a case, however, the row of the reacting liquid ejection orifices is placed downstream side of the row of the respective coloring ink ejection orifices along the direction of feeding the printing sheet; the number of the reacting liquid ejection orifices is n, and the number of the ink ejection orifices may be (n−a) corresponding to the first embodiment or n corresponding to the second embodiment. Further, in the system corresponding to the first embodiment, the scanning area for each coloring ink and the scanning area for the reacting liquid are set adjacent to each other; the width (B) of the scanning area for the reacting liquid is set longer than the width (A) of the scanning area for the ink by a predetermined length (C); the amount of the feeding printing sheet is made equal to the width (A) of the above-mentioned scanning area for the ink. Further, in the system employed for the second embodiment, the scanning area for each coloring ink and the scanning area for the reacting liquid are set adjacent to each other; the scanning area for each coloring ink and the scanning area for the reacting liquid are set adjacent to each other; the width (A) of the scanning area for the reacting liquid is set equal to the width (A) of the scanning area for each ink; the amount of the feeding of the paper sheet is set shorter than the width (A) of the scanning area for the ink.

Further, as described in connection with the above-mentioned embodiment, the width of the scanning area for each coloring ink and that of the scanning area for the reacting liquid are normally dependent on the length of the row of the ejection orifices provided with the corresponding printing head and the amount of the feeding of the paper sheet; however, since the printing can be made by using the part of the available ejection orifices; in such a case, needless to say, the width of the scanning area is dependent on the length of the row of the ejection orifices corresponding to the length of the row of the actually used number of orifices.

Further, each of the above-mentioned embodiments is proposed assuming a system for the arrangement of the printing heads designed for dissolving the problem relating to the order in which the ink and the reacting liquid are deposited overlapping with each other in the 2-way printing process; however, the application of the present invention is not limited to the arrangement of the printing heads adapted only to the 2-way printing system. For instance, depending on the kind of the image to be printed or the specifications of (the printing) apparatus, there is the possibility that the embodiments of the present invention may be applied to 1-way printing on the basis of 1-way scanning. In such a case, there is the possibility that, depending on the difference in the permeability among the ink, reacting liquid and the printing medium, the reacting liquid and the ink, which are deposited adjacently with each other can cause insufficient reaction with each other in the boundary thereof and the resultant development of the white streaks, which is the technical problem to be solved by the present invention. Even in such a case, it is possible to reduce the development of the white streaks by applying the printing operation and process defined in each of the above-mentioned embodiments.

Further, regarding the arrangement of the printing heads, in each of the above-mentioned embodiments, the row of the reacting liquid ejection orifices or the printing head is placed adjacent to the row of the cyan (C) ink ejection orifices or the printing head along the direction of the backward scan; however, needless to say, in the present embodiment, the row of the reacting liquid orifices or the printing head may be placed adjacent to the row of the ejection orifices of other kind of ink. In other words, as is obvious from the foregoing description, it is sufficient that the scanning area for the ink and the scanning area for the reacting liquid are placed adjacent to each other in the direction of the backward scanning.

Further Other Embodiment

The present invention may be applied to the system comprising a plurality of apparatuses (e.g., the host computer, interface apparatus, printer or the like) or a single apparatus (e.g., the printer, copying apparatus, facsimile).

Further, those devices incorporating the function made availabe based on the embodiments of the present invention or the software or the program for the system, apparatus or the computer (CPU or MPU) designed incorporating the embodiments of the present invention are included in the present invention.

Further, when the above-mentioned program or the software incorporates the functions of the above-mentioned embodiments, not only those programs or software but also the means, such as the memory, storing the program codes, for providing the computer with such program or software are also constitute the present invention.

As the memories capable of storing such program codes based on the present invention, there are, for example, the floppy disks (Registered Trademark), disk, hard disk, optical disk, magneto-optical disk, CD-ROM, magnetic tape, non-volatile memory card, ROM.

Further, not only when the program codes (incorporating any function of the embodiment of the present invention) is executed by the computer but also when the program code is executed in collaboration with the OS (the operation system) or other application software, needless to say, such program codes are included in the embodiments of the present invention.

Further, when the program codes (incorporating any function of the embodiment of the present invention) is stored in the function extension board of the computer or the memory provided with such function extension board, and the data are totally or partially processed by the CPU according to the instructions given by such program codes to realize the whole or the part of the function of the above-mentioned embodiments (of the present invention), such operation is, needlessly to say, included in the scope of the present invention.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

The invention claimed is:

1. An ink jet printing method of performing printing by repeating a scanning step for scanning a row of ink ejection orifices for ejecting ink and a row of reacting liquid ejection orifices for ejecting a reacting liquid that reacts with the ink, across a printing medium, in order to eject the ink and the reacting liquid onto the printing medium, and a feeding step for feeding the printing medium, wherein said scanning step performs the scan of the row of ink ejection orifices and the row of reacting liquid ejection orifices, so that a scanning area of the ink to which the ink is ejected while the row of ink ejection orifices scans and a scanning area of the reacting liquid to which the reacting liquid is ejected while the row of reacting liquid ejection orifices scans are adjacent to each other in a feeding direction of the printing medium, and, among the ink and the reacting liquid that have different permeability, a width of the scanning area of a liquid having relatively high permeability along the feeding direction is made greater than that of the scanning area of a liquid having relatively low permeability, said feeding step feeds the printing medium, by an amount corresponding to a width which is smaller than the width of the scanning area of the liquid having relatively high permeability by a predetermined amount so that the liquid having relatively high permeability is ejected on the liquid having relatively low permeability, ejection of the liquid having relatively low permeability onto the scanning area of the reacting liquid ejection orifices is performed during a single scan, and at least for the liquid having relatively high permeability, ejection of the liquid onto a first scanning area, which corresponds to a width of the predetermined amount within the scanning area of the liquid, is performed during two scans, and ejection of the liquid onto a second scanning area other than the first scanning area, within the scanning area of the liquid, is performed during a single scan.

2. An ink jet printing method as claimed in claim 1, wherein the row of ink ejection orifices includes (n) ejection orifices and the row of reacting liquid ejection orifices includes (n−a) ejection orifices.

3. An ink jet printing method as claimed in claim 1, wherein the row of ink ejection orifices and the row of reacting liquid ejection orifices include (n) ejection orifices respectively, and said feeding step feeds the printing medium by an amount of(n−a)×p (where p denotes a pitch of the (n) ejection orifices).

4. An ink jet printing method as claimed in claim 1, wherein the row of ink ejection orifices and the row of reacting liquid ejection orifices are provided in a manner that the row of ink ejection orifices and the row of reacting liquid ejection orifices are adjacent to each other in the feeding direction.

5. An ink jet printing method as claimed in claim 1, wherein the ink or the reacting liquid is ejected during a first scan by said scanning step in which the row of ink ejection orifices and the row of reacting liquid ejection orifices are subjected to a forward scan, then said feeding step feeds the printing medium, and then the ink or the reacting liquid is ejected during a second scan by said scanning step in which the row of ink ejection orifices and the row of reacting liquid ejection orifices are subjected to a backward scan.

6. An ink jet printing method of performing printing by repeating a scanning step for scanning a row of ink ejection orifices for ejecting ink having a predetermined permeability and a row of reacting liquid ejection orifices for ejecting a reacting liquid that has lower permeability than the predetermined permeability of the ink and reacts with the ink, across a printing medium, in order to eject the ink and the reacting liquid onto the printing medium, and a feeding step for feeding the printing medium, wherein said scanning step performs the scan of the row of ink ejection orifices and the row of reacting liquid ejection orifices, so that a scanning area of the ink ejection orifices to which the ink is ejected while the row of ink ejection orifices scans and a scanning area of the reacting liquid ejection orifices to which the reacting liquid is ejected while the row of reacting liquid ejection orifices scans are adjacent to each other in a feeding direction of the printing medium, and a width of the scanning area of the reacting liquid ejection orifices along the feeding direction is made smaller than that of the scanning area of the ink ejection orifices by a predetermined amount, said feeding step feeds the printing medium by an amount corresponding to the width of the scanning area of the reacting liquid ejection orifices, the row of reacting liquid ejection orifices is located at an upstream side of the row of ink ejection orifices in the feeding direction so that the scanning area of the ink ejection orifices and the scanning area of the reacting liquid ejection orifices are made adjacent to each other in the feeding direction in the same scan, ejection of the reacting liquid onto the scanning area of the reacting liquid ejection orifices is performed during a single scan, and ejection of the ink onto a first scanning area, which corresponds to a width of the predetermined amount within the scanning area of the ink ejection orifices, is performed during two scans, and ejection of the ink onto a second scanning area other than the first scanning area, within the scanning area of the ink ejection orifices, is performed during a single scan.

7. An ink jet printing method comprising:

a providing step for providing a printing head in which a row of (n) ink ejection orifices for ejecting ink having a predetermined permeability and a row of (n−a) reacting liquid ejection orifices for ejecting a reacting liquid that has lower permeability than the predetermined permeability of the ink and reacts with the ink are arranged to be adjacent to each other in an array direction of the orifices;

a scanning step for scanning the printing head in a different direction from the array direction across a printing medium so that a scanning area of the reacting liquid ejection orifices, which has a width corresponding to the (n−a) orifices, and a scanning area of the ink ejection orifices, which has a width corresponding to the (n) ink ejection orifices, are adjacent to each other during a single scan; and a feeding step for feeding the printing medium in a direction perpendicular to the direction of scanning by a width corresponding to the (n−a) ejection orifices, between two successive scans by said scanning step, wherein ejection of the reacting liquid onto the scanning area of the reacting liquid ejection orifices is performed during a single scan, and within the scanning area of the ink ejection orifices, ejection of the ink onto respective scanning areas, each of which has a width corresponding to (a) ejection orifices and which are located at respective end portions of the row of ink ejection orifices, is performed during two scans, and ejection of the ink onto a scanning area, which has a width corresponding to (n−a) ejection orifices and is not located at an end portion, is performed during a single scan.

8. An ink jet printing apparatus comprising scanning means for scanning a row of ink ejection orifices for ejecting ink and a row of reacting liquid ejection orifices for ejecting a reacting liquid that reacts with the ink, across a printing medium, in order to eject the ink and the reacting liquid onto the printing medium, and feeding means for feeding the printing medium, the ink jet printing apparatus repeating the scanning and the feeding to perform printing, wherein said scanning means performs the scan of the row of ink ejection orifices and the row of reacting liquid ejection orifices, so that a scanning area of the ink to which the ink is ejected while the row of ink ejection orifices scans and a scanning area of the reacting liquid to which the reacting liquid is ejected while the row of reacting liquid ejection orifices scans are adjacent to each other in a feeding direction of the printing medium, and, among the ink and the reacting liquid that have different permeability, a width of the scanning area of a liquid having relatively high permeability along the feeding direction is made greater than that of the scanning area of a liquid having relatively low permeability, said feeding means feeds the printing medium, by an amount corresponding to a width which is smaller than the width of the scanning area of the liquid having relatively high permeability by a predetermined amount so that the liquid having relatively high permeability is ejected on the liquid having relatively low permeability, ejection of the liquid having relatively low permeability onto the scanning area of the reacting liquid ejection orifices is performed during a single scan, and at least for the liquid having relatively high permeability, ejection of the liquid onto a first scanning area, which corresponds to a width of the predetermined amount within the scanning area of liquid, is performed during two scans, and ejection of the liquid onto a second scanning area other than the first scanning area, within the scanning area of the liquid, is performed during a single scan.

9. An ink jet printing apparatus comprising scanning means for scanning a row of ink ejection orifices for ejecting ink having a predetermined permeability and a row of reacting liquid ejection orifices for ejecting a reacting liquid that has lower permeability than the predetermined permeability of the ink and reacts with the ink, across a printing medium, in order to eject the ink and the reacting liquid onto the printing medium, and feeding means for feeding the printing medium, the ink jet printing apparatus repeating the scanning and the feeding to perform printing, wherein said scanning means performs the scan of the row of ink ejection orifices and the row of reacting liquid ejection orifices, so that a scanning area of the ink ejection orifices to which the ink is ejected while the row of ink ejection orifices scans and a scanning area of the reacting liquid ejection orifices to which the reacting liquid is ejected while the row of reacting liquid ejection orifices scans are adjacent to each other in a feeding direction of the printing medium, and a width of the scanning area of the reacting liquid ejection orifices along the feeding direction is made smaller than that of the scanning area of the ink ejection orifices by a predetermined amount, said feeding means feeds the printing medium by an amount corresponding to the width of the scanning area of the reacting liquid ejection orifices, the row of reacting liquid ejection orifices is located at an upstream side of the row of ink ejection orifices in the feeding direction so that the scanning area of the ink ejection orifices and the scanning area of the reacting liquid ejection orifices are made adjacent to each other in the feeding direction in the same scan, ejection of the reacting liquid onto the scanning area of the reacting liquid ejection orifices is performed during a single scan, and ejection of the ink onto a first scanning area, which corresponds to a width of the predetermined amount within the scanning area of the ink ejection orifices, is performed during two scans, and ejection of the ink onto a second scanning area other than the first scanning area, within the scanning area of the ink ejection orifices, is performed during a single scan.

10. An ink jet printing apparatus using a printing head in which a row of (n) ink ejection orifices for ejecting ink having a predetermined permeability and a row of (n−a) reacting liquid ejection orifices for ejecting a reacting liquid that has lower permeability than the predetermined permeability of the ink and reacts with the ink are arranged to be adjacent to each other in an array direction of the orifices and which ejects the ink and the reacting liquid onto a printing medium to perform printing, said apparatus comprising:

scanning means for scanning the printing head in a different direction from the array direction across a printing medium so that a scanning area of the reacting liquid ejection orifices, which has a width corresponding to the (n−a) orifices, and a scanning area of the ink ejection orifices, which has a width corresponding to the (n) ink ejection orifices, are adjacent to each other during a single scan; and feeding means for feeding the printing medium in a direction perpendicular to the direction of scanning by a width corresponding to the (n−a) ejection orifices, between two successive scans by said scanning means, wherein ejection of the reacting liquid onto the scanning area of the reacting liquid ejection orifices is performed during a single scan, and within the scanning area of the ink ejection orifices, ejection of the ink onto respective scanning areas, each of which has a width corresponding to (a) ejection orifices and which are located at respective end portions of the row of ink ejection orifices, is performed during two scans, and ejection of the ink onto a scanning area, which has a width corresponding to (n−a) ejection orifices and is not located at an end portion, is performed during a single scan.

* * * * *

UNITED STATES PATENT AND TRADEMARK OFFICE

CERTIFICATE OF CORRECTION

PATENT NO. : 7,311,394 B2
APPLICATION NO. : 10/549674
DATED : December 25, 2007
INVENTOR(S) : Ishikawa et al.

It is certified that error appears in the above-identified patent and that said Letters Patent is hereby corrected as shown below:

COLUMN 1:
Line 10, “a” (second occurrence) should read --an--.
Line 15, “are that eject” should read --involve ejecting--.
Line 21, “(1986)and” should read --(1986) and--.
Line 47, “together(hereinafter” should read --together (hereinafter--.
Line 48, “deferent” should read --different--.

COLUMN 2:
Line 39, “referred” should read --referred to--.
Line 45, “occur” should read --occurs--.
Line 54, “to be uneveness” should read --resulting in uneven--.
Line 67, “forwarding” should read --forward--.

COLUMN 3:
Line 6, “forwarding” should read --forward--.
Line 27, “head” should read --heads--.
Line 39, “ejected and landed to” should read --is ejected and lands on--.
Line 40, “adheres” should read --adhere--.

COLUMN 4:
Line 2, “landed” should be deleted.
Line 17, “an” should read --a--.
Line 63, “remain” should read --remains--.

COLUMN 5:
Line 25, “a” should be deleted.

COLUMN 6:
Line 57, “successive two scanning” should read --two successive scans--.

COLUMN 7:
Line 23, “successive two scanning” should read --two successive scans--.
Line 64, “a” should read --an--.

UNITED STATES PATENT AND TRADEMARK OFFICE

CERTIFICATE OF CORRECTION

PATENT NO. : 7,311,394 B2
APPLICATION NO. : 10/549674
DATED : December 25, 2007
INVENTOR(S) : Ishikawa et al.

It is certified that error appears in the above-identified patent and that said Letters Patent is hereby corrected as shown below:

COLUMN 8:
Line 20, “of-the” should read --of the--.
Line 32, “successive two scanning” should read --two successive scans--.
Line 64, “successive two scanning” should read --two successive scans--.

COLUMN 10:
Line 42, “successive two scanning” should read --two successive scans--.

COLUMN 11:
Line 8, “successive two scanning” should read --two successive scans--.
Line 33, “scanning,means” should read --scanning means--.
Line 51, “the-scanning” should read --the scanning--.

COLUMN 12:
Line 18, “successive two scanning” should read --two successive scans--.
Line 51, “successive two scanning” should read --two successive scans--.

COLUMN 13:
Line 30, “a” (first occurrence) should be deleted.
Line 51, “an” should read --a--.

COLUMN 14:
Line 35, “laps” should read --lapse--.
Line 60, “oxide.2, 4,7,9-tetramethyl-5.decyne-4,7-diol” should read --oxide-2,4,7,9-tetramethyl-5-decyne-4,7-diol--.

COLUMN 16:
Line 26, “move” should read --to move--.
Line 30, “move” should read --to move--.
Line 46, “precedently” should read --preceding--.
Line 47, “precedently” should read --preceding--.
Line 63, “landed” should read --made to land--.

UNITED STATES PATENT AND TRADEMARK OFFICE

CERTIFICATE OF CORRECTION

PATENT NO. : 7,311,394 B2
APPLICATION NO. : 10/549674
DATED : December 25, 2007
INVENTOR(S) : Ishikawa et al.

It is certified that error appears in the above-identified patent and that said Letters Patent is hereby corrected as shown below:

COLUMN 17:
Line 7, “vicinity” should read --in the vicinity of--.
Line 66, “whole” should read --all--.

COLUMN 18:
Line 10, “whole” should read --all--.
Line 62, “A=(n–a )×xp.” should read --A=(n–a)×p.--.

COLUMN 19:
Line 51, “describe” should read --described--.

COLUMN 20:
Line 20, “comes” should read --to come--.
Line 43, “is” should be deleted.

COLUMN 21:
Line 44, “the” (first occurrence) should be deleted.

COLUMN 22:
Line 6, “kept remain” should read --maintained--.
Line 46, “plolyal-” should read --polyal- --.
Line 49, “anlogs” should read --analogs--.
Line 56, “weigh” should read --weight--.

COLUMN 23:
Line 32, “C.I. Pigment Yellow 16,” should be deleted.
Line 36, “Red57” should read --Red 57--.
Line 40, “C.I. Pigment” should be deleted.
Line 41, “Blue 22, C.I. Pigment Blue 4,” should be deleted.
Line 66, “soluble in aqueous solution” should read --are soluble in the aqueous solution of--.

UNITED STATES PATENT AND TRADEMARK OFFICE

CERTIFICATE OF CORRECTION

PATENT NO. : 7,311,394 B2
APPLICATION NO. : 10/549674
DATED : December 25, 2007
INVENTOR(S) : Ishikawa et al.

It is certified that error appears in the above-identified patent and that said Letters Patent is hereby corrected as shown below:

COLUMN 24:
Line 6, “kept” should read --kept in a--.
Line 13, “sued” should read --used--.
Line 17, “hyrooxide,” should read --hydroxide,--.

COLUMN 25:
Line 5, “comprises” should read --comprise--.
Line 7, “containing” should read --contains--.
Line 10, “and:the” should read --and the--.
Line 19, “is” should read --it is--.
Line 20, “need” should read --needs--, and “preferable to be” should read --preferably--.
Line 38, “high-speeds and” should read --high-speed sand--.

COLUMN 26:
Line 27, “parts” should read --part--.
Line 57, “Chemial)” should read --Chemical)--.

COLUMN 28:
Line 3, “shown” should read --shown in--.
Line 60, “adjacent-two” should read --two adjacent--.

COLUMN 29:
Line 25, “such” should be deleted.

COLUMN 30:
Line 45, “cans.” should read --scans.--.
Line 57, “The most” should read --Most--.

COLUMN 31:
Line 13, “cans” should read --scans--.

UNITED STATES PATENT AND TRADEMARK OFFICE

CERTIFICATE OF CORRECTION

PATENT NO. : 7,311,394 B2
APPLICATION NO. : 10/549674
DATED : December 25, 2007
INVENTOR(S) : Ishikawa et al.

It is certified that error appears in the above-identified patent and that said Letters Patent is hereby corrected as shown below:

COLUMN 32:
Line 34, “row” should read --a row--.
Line 35, “row” should read --a row--.
Line 67, “feeding” should read --feeding of the--.

COLUMN 33:
Line 52, “other” should read --another--.

COLUMN 34:
Line 9, “are” should be deleted.

Signed and Sealed this

Tenth Day of March, 2009

John Doll

JOHN DOLL
*Acting Director of the United States Patent and Trademark Office*